US006675900B2

(12) United States Patent
Baskett et al.

(10) Patent No.: US 6,675,900 B2
(45) Date of Patent: Jan. 13, 2004

(54) CROSSOVER TREE SYSTEM

(76) Inventors: David C. Baskett, 16203 Green Smoke, Houston, TX (US) 77095; Edwin R. Knerr, 15409 Ashburton, Houston, TX (US) 77040

( * ) Notice: Subject to any disclaimer, the term of this patent is extended or adjusted under 35 U.S.C. 154(b) by 0 days.

(21) Appl. No.: 10/316,294

(22) Filed: Dec. 11, 2002

(65) Prior Publication Data

US 2003/0102135 A1 Jun. 5, 2003

Related U.S. Application Data

(63) Continuation of application No. 09/774,295, filed on Jan. 29, 2001, now abandoned.
(60) Provisional application No. 60/178,845, filed on Jan. 27, 2000.

(51) Int. Cl.[7] ..... E21B 23/00; E21B 33/035; E21B 33/043; E21B 33/04

(52) U.S. Cl. ..... 166/379; 166/75.14; 166/85.4; 166/86.2; 166/86.3; 166/87.1; 166/88.4; 166/89.3; 166/97.1; 166/368; 166/382

(58) Field of Search ..... 166/75.14, 85.4, 166/86.2, 86.3, 87.1, 88.4, 89.3, 95.1, 97.1, 347, 348, 368, 379, 382

(56) References Cited

U.S. PATENT DOCUMENTS

| | | | | | |
|---|---|---|---|---|---|
| 3,042,427 | A | * | 7/1962 | Word, Jr. | 166/89.2 |
| 3,279,536 | A | | 10/1966 | Wakefield, Jr. | |
| 3,310,107 | A | * | 3/1967 | Yancey | 166/348 |
| 3,662,822 | A | | 5/1972 | Wakefield, Jr. | |
| 4,125,155 | A | * | 11/1978 | Brock, Jr. | 166/319 |
| 4,133,378 | A | | 1/1979 | Gano | |
| 4,154,298 | A | | 5/1979 | Gano | |
| 4,886,121 | A | | 12/1989 | Demmy et al. | 166/382 |
| 5,143,158 | A | * | 9/1992 | Watkins et al. | 166/344 |
| 5,372,199 | A | | 12/1994 | Cegielski et al. | 166/368 |
| 5,544,707 | A | | 8/1996 | Hopper et al. | 166/382 |
| 5,868,204 | A | * | 2/1999 | Pritchett et al. | 166/368 |
| 5,988,282 | A | * | 11/1999 | Jennings et al. | 166/348 |
| 6,039,119 | A | * | 3/2000 | Hopper et al. | 166/348 |
| 6,050,339 | A | * | 4/2000 | Milberger | 166/368 |
| 6,062,314 | A | | 5/2000 | Nobileau | |
| 6,460,621 | B2 | * | 10/2002 | Fenton et al. | 166/347 |
| 2001/0011593 | A1 | * | 8/2001 | Wilkins | 166/368 |

FOREIGN PATENT DOCUMENTS

| | | |
|---|---|---|
| GB | 2166775 A | 5/1986 |
| GB | 2192921 A | 1/1988 |
| WO | WO 86/01852 | 5/1986 |

OTHER PUBLICATIONS

SPE 23050, *Electrical Submersible Pumps in Subsea Completions*, P.A. Scott, M. Bowring and B. Coleman, 1991.
*Electric Submersible Pump for Subsea Completed Wells*, Sigbjorn Sangesland, Nordic Counsel of Ministers Program for Petroleum Technology, Nov. 26–27, 1991.
*A Simplified Subsea System Design*, Sigbjorn Sangesland, Underwater Technology Conference, Bergen 1990.

(List continued on next page.)

*Primary Examiner*—George Suchfield
(74) *Attorney, Agent, or Firm*—Howrey Simon Arnold & White LLP

(57) ABSTRACT

A subterranean oil or gas well apparatus is provided. The apparatus includes a single-bore production tubing hanger arranged concentric with a wellhead. The tubing hanger includes a plurality of ports and channels arranged about the tubing hanger to give operators access to the production tubing annulus and provide chemical injection capability. The ports are closable by a sliding valve. The apparatus also includes annulus and production radial-bore stab assemblies between a christmas tree and an internal crossover assembly. The stab assemblies are extendable and retractable between the chirstmas tree and the crossover assembly to allow the retrieval and installation of each independently.

59 Claims, 40 Drawing Sheets

OTHER PUBLICATIONS

*Simplified Subsea System Design*, Sigbjorn Sangesland, Subsea Production Technology, CE–Course, Oct. 23–27 and Nov. 20–24, 1989.

*A Simplified Subsea System Design*, Sigbjorn Sangesland, Presented at Underwater Technology Conference in Bergen, Mar. 19–21, 1990.

*Declaration of David Lorimer* (*and attachments dated 1991*), David Lorimer, Submitted in Civil Action No. H–97–0155 (Cooper Cameron Corp. v. Kvaerner Oilfield Prods, Inc.), Jul. 10, 2002.

*Subsea Submersible Pumping Project Task Series 1000 Equipment Evaluation*, Vetco Gray.

*First Interim Report—Technical*, Subsea Intervention System, Ltd., Project No. TH/03328/89, Jan. 1991.

*Subsea Submersible Pumping Project Task No. 2000 Conceptual Design Report*, Jan., 1991.

*Second Interim Report—Technical*, Subsea Intervention Systems, Ltd., Project No. TH/03328/89, Jun. 1991.

*Third Interim Report—Technical*, Subsea Intervention Systems, Ltd., Project No. TH/03328/89, Dec. 1991.

*Subsea Submersible Pumping Project, Final Report Volume 1*, Subsea Intervention Systems, Ltd., Task Nos. 3000 and 4000, Mar. 1992.

*Subsea Submersible Pumping Project, Final Report Volume 2*, Subsea Intervention Systems, Ltd., Task Nos. 3000 and 4000, Mar. 1992.

*Subsea Submersible Pumping Project, Final Report Volume 3*, Subsea Intervention Systems, Ltd., Task Nos. 3000 and 4000, Mar. 1992.

*Through Bore Tree System*, Ref: TSD 6302, National Oilwell (UK) Limited, Jan. 1993.

*Declaration of Sigbjorn Sangesland and Attachments*, Sigbjorn Sangesland, Submitted in Civil Action No. H–97–0155 (Copper Cameron Corp. v. Kvaerner Oilfield Prods Inc.), Undated.

* cited by examiner 70
72
10
2
110
102
21
20
54
99
58
12
4
16
6
68

24
60
26
110
102
21
20
54
99
16
4
68

62
60
110
102
21
2
20
54
99
12
16
6

CROSSOVER TREE SYSTEM

This is a continuation of application Ser. No. 09/774,295, filed Jan. 29, 2001, now abandoned, which claims the benefit of provisional application Ser. No. 60/178,845, filed Jan. 27, 2000, now abandoned; the specifications of both applications being hereby incorporated by reference.

FIELD OF THE INVENTION

This invention relates generally to subsea oil and gas production methods and apparatus and, more particularly, to a crossover christmas tree system.

BACKGROUND OF THE INVENTION

It is conventional practice to complete a subsea well with a multi bore tubing hanger with tubing suspended below. One bore is a production bore of between 5 and 10 inches nominal diameter and the other is a smaller annulus bore of about 2 inches. The tubing hanger and the associated tubing are run into a subsea wellhead on a running assembly comprising a tubing hanger running tool and a multi bore riser until the tubing hanger is landed and sealed in a wellhead housing. The wellhead carries a blowout preventor (BOP) stack which is connected to a marine riser through which the tubing hanger is run.

This configuration, with the bores side-by-side is typical because it is relatively simple to seal off the bores in the tubing hanger. This is done immediately after the tubing hanger has been landed by running and setting at least one plug into each bore through the multi bore riser used to install the tubing hanger using a wireline technique so that the plugs close the bores and secure the well during the time the tubing hanger is exposed to the ambient environment.

Once the plugs are installed, the multi bore riser is disconnected from the tubing hanger and retrieved to the surface, after which the BOP stack is disconnected from the subsea wellhead and retrieved to the surface with the marine riser. At this point, the tubing hanger is exposed to the ambient environment. The multi bore riser is re-used to run a christmas tree which is landed and locked into the subsea wellhead simultaneously establishing connections to the tubing hanger. The christmas tree is installed using a running assembly comprising the multi bore riser, a safety package including wireline cutting valves and an emergency disconnect package which allows the separation of the surface vessel in the event that it becomes necessary to disconnect the surface vessel from the wellhead. The multi bore riser leads from the upper end of the emergency disconnect package to the vessel. Wirelines can be deployed through the multi bore riser, the safety package and the christmas tree in order to retrieve the plugs in the production bore and the annulus bore. The christmas tree valves are then shut while the safety package and the multi bore riser are retrieved to the surface. The christmas tree is then capped.

In deeper water, the viability of such a conventional multi bore riser is open to question both from structural and commercial viewpoints. In addition, there are many applications in which a larger full bore is desirable. Alternatives to multi bore riser systems utilizing a single bore have been proposed for running and for operating with a christmas tree but, while they can be used for plugging the production bore, they suffer from the problem of providing annulus access with sufficient flow rate capacities to treat a well—and the lack of annulus flow control.

Further, in deep water it becomes very difficult to align side-valve christmas tree ports with the tubing hanger.

Finally, well drilling and completion operations are very expensive and often based on per hour rig charges. It is desirable to complete wells with a few downhole trips as possible to reduce rig time. In a conventional tubing hanger and christmas tree assembly, the retrieval of the tubing hanger also requires the retrieval of the christmas tree. It would be desirable and cost efficient to find a system that would allow separate retrieval of the christmas tree and tubing hanger.

The present invention is directed to eliminating, or at least reducing the effect of, one or more of the issues raised above.

SUMMARY OF THE INVENTION

The invention is directed to a style of christmas tree wherein the tubing hanger is landed in the wellhead, and both the tree and the tubing hanger can be removed independently. This independent ability to retrieve either the tree or the tubing hanger, as required, is achieved through the use of a crossover piece in the tree. When installed, the crossover piece directs the flow of the production fluid to the production valves outside the tree, and directs the flow of fluids to or from the tubing annulus. When the crossover piece is removed, full-bore access through the tree is available, and the tubing hanger, landed below the tree can be removed with the tree in place One exemplary embodiment of the present invention encompasses a subsea oil or gas well assembly. Such an embodiment includes: a wellhead; a christmas tree coupled to the wellhead; and a tubing hanger landed within the wellhead. A sliding valve is disposed within the tubing hanger to selectively allow fluid communication between a first port in the sliding valve and a first port in the tubing hanger. A crossover assembly is landed within the tree body, and a crossover stab is disposed within the crossover assembly and adapted to translate the sliding valve between open and closed positions.

A subsea oil or gas well assembly comprising: a wellhead; a christmas tree coupled to the wellhead; and a single bore tubing hanger landed within the wellhead. The tubing hanger includes production tubing suspended from it as should be known in the art. The single bore tubing hanger further includes a plurality of first closable ports which facilitate fluid communication to an annulus defined by the production tubing and an innermost casing.

These and other features of the present invention are more fully set forth in the following description of preferred or illustrative embodiments of the invention.

BRIEF DESCRIPTION OF THE DRAWINGS

The foregoing and other features and aspects of the invention will become further apparent upon reading the following detailed description and upon reference to the drawings in which.

Figure 1:
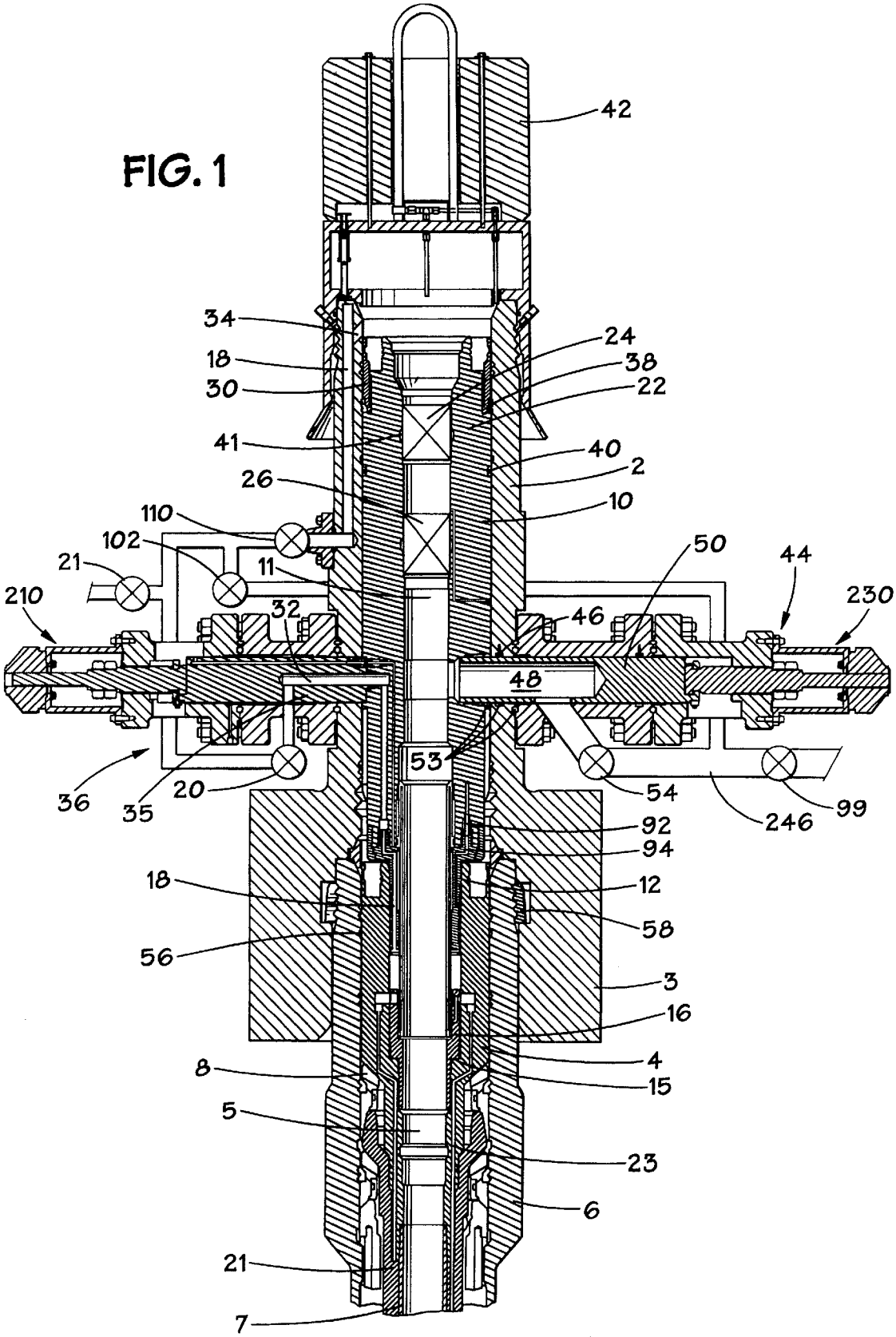
FIG. 1 depicts a crossover tree design in accordance with one aspect of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Previous attempts to develop a tree with the advantages of a crossover tree have resulted in designs wherein a false or dummy tubing hanger is installed in the tree. U.S. Pat. No. 5,372,199 is one example of such a design. Similar designs were offered for sale by National Oilwell prior to the date of the cited patent. However, such designs were cumbersome and required additional steps to retrieve specific components. The current invention overcomes this and other limitations of the prior art trees.

Figure 10:
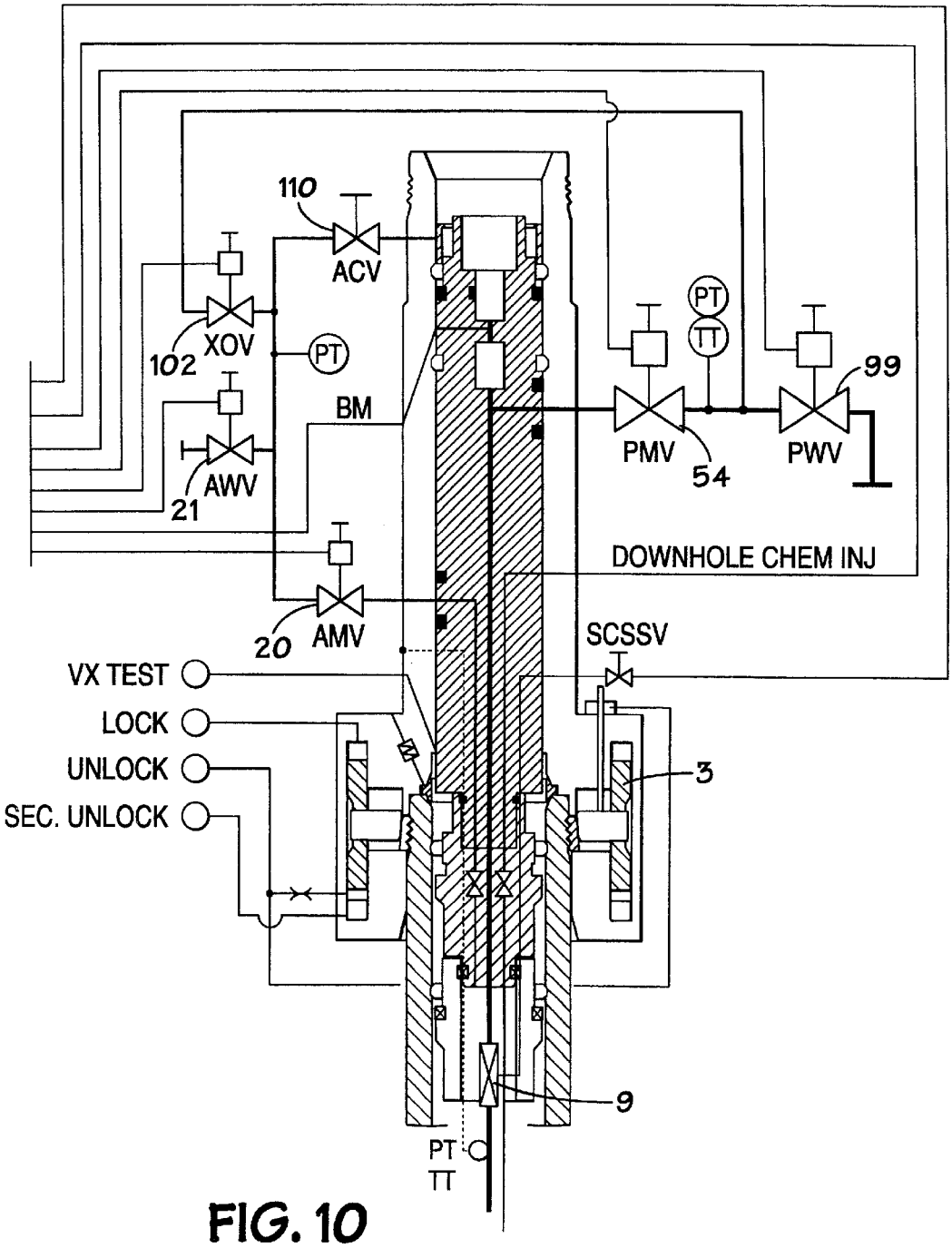
FIG. 10 depicts a hydraulic schematic for the crossover tree system (CTS) in the production mode.
Figure 11:
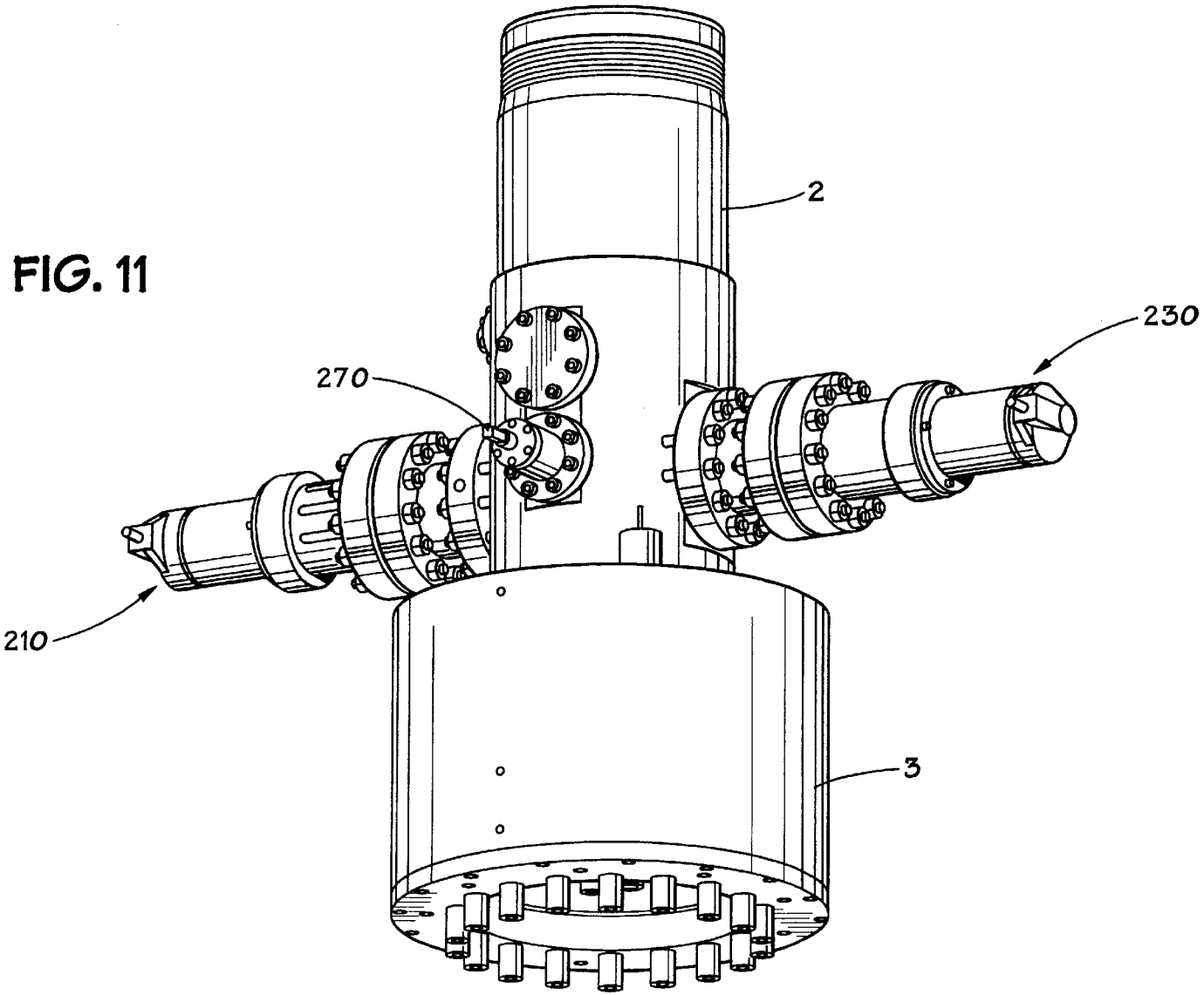
FIG. 11 depicts a perspective overview of the CTS.

Turning now to the Figures, and in particular FIG. 1, a crossover christmas tree 2 with a tubing hanger 4 installed within a wellhead 6 in accordance with one embodiment of the invention is disclosed. The assembly shown in FIG. 1 represents one embodiment of the crossover tree system and the associated assembly fully installed. Tree 2 is connected to a wellhead 6 by a tree connector 3. As shown in FIG. 10, tree connector 3 can be hydraulically actuated such that a lock down ring 58 mates with an exterior profile on wellhead 6. Other types of tree connectors generally known in the art can be adapted to couple the tree 2 to the wellhead 6.

The assembly shown in FIG. 1 includes tubing hanger 4, which is installed substantially concentrically within wellhead 6. In one embodiment, tubing hanger 4 is a concentric tubing hanger, having a production bore seven inches in diameter, but may range in size as required for a particular field development. Eccentric or dual bore tubing hangers may be used, in other embodiments not shown. Tubing hanger 4 rests on a shoulder 8 of wellhead 6, and the annulus between then tubing hanger 4 and the wellhead 6 is sealed.

A tubing hanger lock down ring 56 helps secure tubing hanger 4 within wellhead 6. The lower end of tubing hanger 4 suspends a downhole tubing 7 (shown schematically in FIG. 10) to facilitate a production flow from wellbore to surface when the downhole safety valve 9 is open.

A crossover assembly 10 is disposed within the bore of the crossover tree 2 such that the assembly bore 11 is substantially coaxial with the bore 5 in the tubing hanger 4. A crossover stab 12 sealably mates with tubing hanger 4. The annulus between the crossover assembly 10 and the tree 2 is sealed, for example by crossover seal 40 disposed between the crossover assembly 10 and tree 2.

In the embodiment shown in FIG. 1, crossover assembly 10 and crossover stab 12 are installed substantially concentrically with hanger 4, with the distal end of crossover stab 12 extending partially through the interior of hanger 4. As seen more distinctly in FIGS. 15A and 15B, a plurality of seals 14 seal between hanger 4 and crossover stab 12. Disposed between crossover stab 12 and hanger 4 is a sliding valve 16, which may also be called a shuttle valve. Sliding valve 16 is shown in the down or operating position in FIG. 1 (the details of sliding valve 16 are discussed below). In some embodiments a biasing element, such as a compressed spring, may be disposed in the area labeled 15 in the FIG. 1 embodiment to bias the sliding valve 16 to a closed (up) position wherein ports such as 17 and 17*a* (as shown more clearly in FIGS. 15A and 15B) are misaligned. In the embodiment shown sliding valve 16 is actuated to a closed position by the application of hydraulic pressure to space 15.

Figure 23:
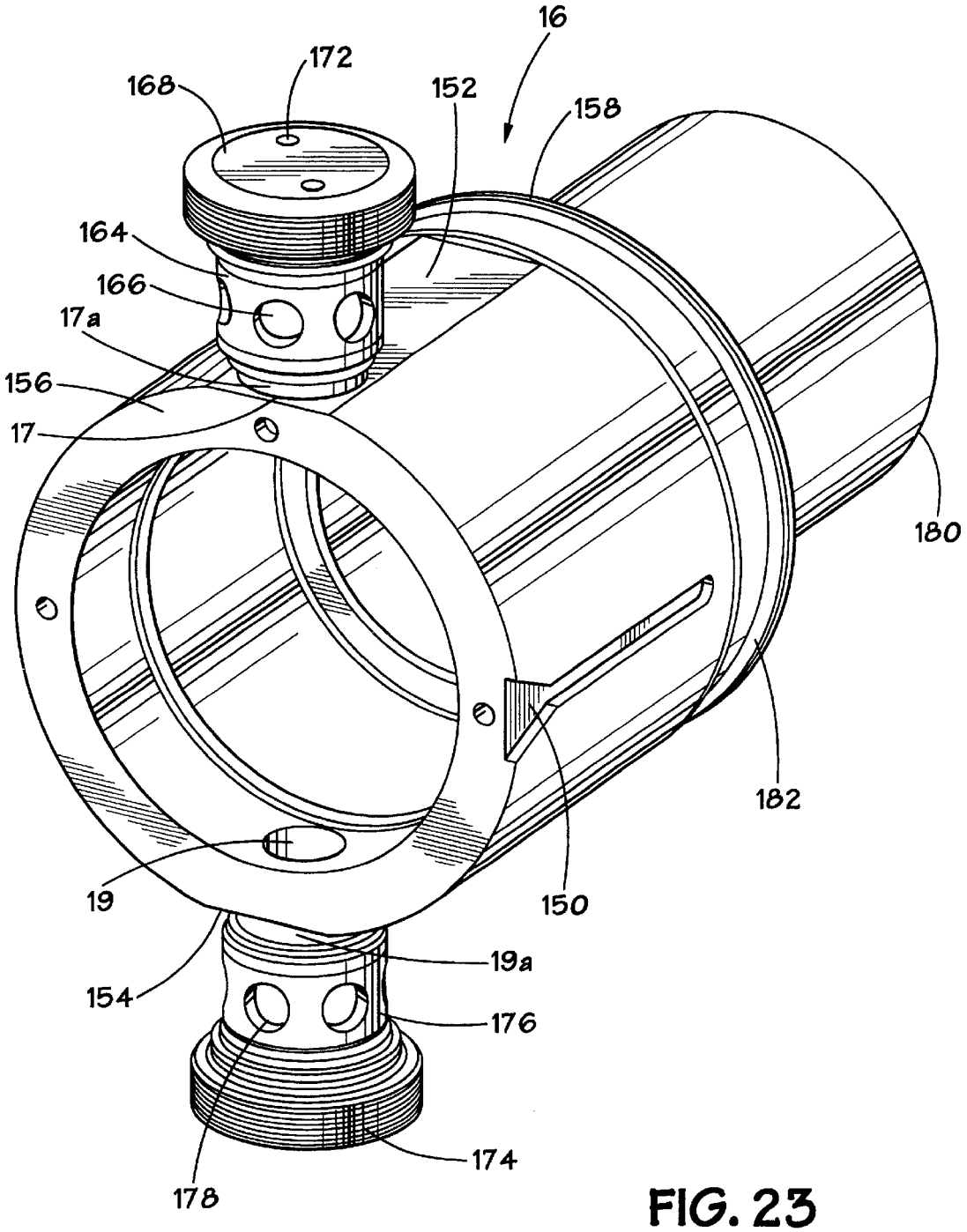
FIG. 23 depicts the tubing hanger shuttle valve detail.
Figure 24:
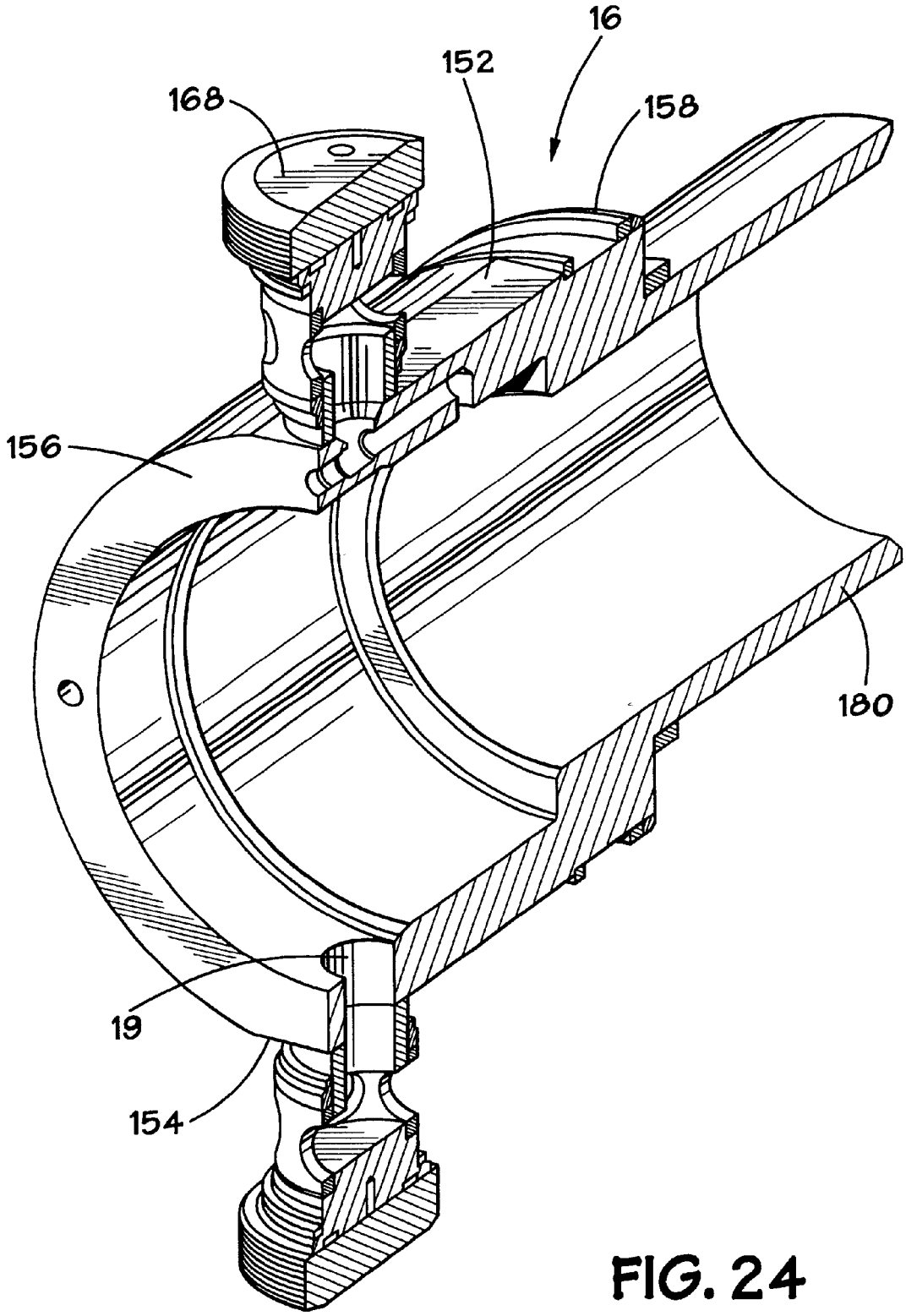
FIG. 24 depicts the tubing hanger shuttle valve detail in cross section.

Referring to FIGS. 23 and 24, sliding valve 16 may include a body 156 with opposing ports or bores 17 and 19. In the embodiment of FIG. 1, bore 17 is a chemical injection access bore or port. Bore or port 19 is shown in the embodiment of FIGS. 23 and 24 as an annulus access bore. Body 156 of valve 16 may exhibit flat machined faces 152 and 154 on the outer diameter of the body at bores 17 and 19. A second chemical injection port 17*a* with a sealing face meets flat machined face 152. Port 17*a* is attached to a spacer 164 and is in fluid communication with chemical injection bore 96 (FIG. 15*a*) via a plurality of holes 166 arranged about the circumference of the spacer. A plurality of seals (not shown) seal between spacer 164 and second port 17*a*.

Adjacent to spacer 164 opposite the port 17*a* is an adjustable plug 168. A plurality of seals (not shown) on adjustable plug 168 inhibits leakage past the plug. Adjustable plug 168, spacer 164, and port 17*a* are arranged within a radial bore 170 in tubing hanger 4. Adjustable plug 168 may have a hex recess 172 to allow an operator to adjust the compression between machined face 152 on and the sealing face of port 17*a*.

As shown in the figures, valve 16 may include an annulus bore or port 19. Annuulus port 19 includes an adjustable plug 174 adjacent annulus spacer 176. Annulus spacer 176 includes a plurality of holes 178 to facilitate fluid communication with annulus bore 19. Adjustable plug 174 may include a plurality of seals (not shown) to inhibit leakage past the plug. Annulus spacer 176 attaches to annulus second port 19*a*. Annulus second port 19*a* includes a sealing face which meets flat machined surface 154. Annulus adjustable plug 174, spacer 176, and second port 19*a* are arranged within a second radial bore 178 in tubing hanger 4. Annulus adjustable plug 174 may have a hex recess (not shown) to allow an operator to adjust the compression between machined face 154 on and the sealing face of second port 19*a*.

Figure 15A:
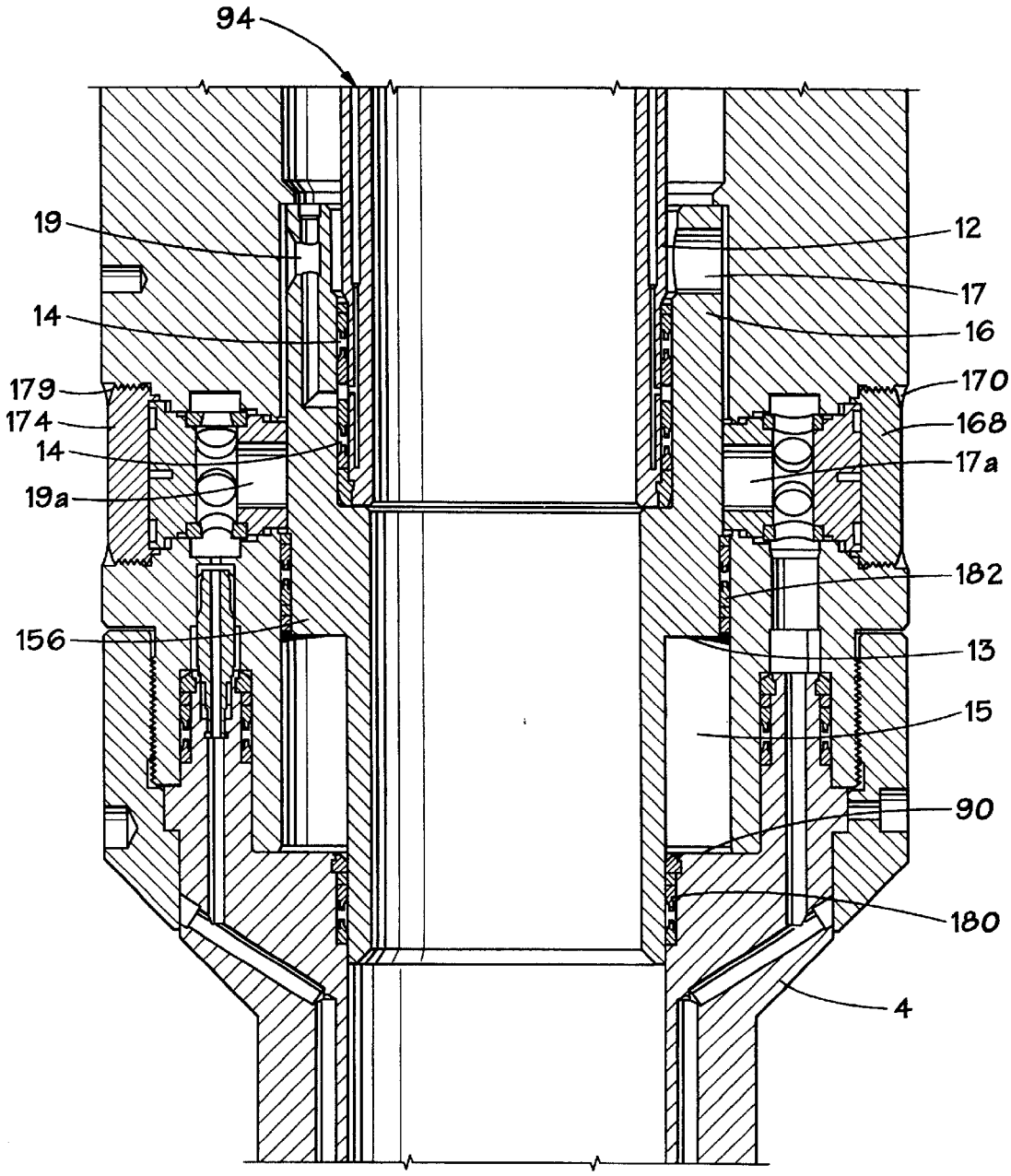
FIG. 15*a* depicts a cross sectional view of the CTS in the extend the crossover assembly stab into the tubing hanger sequence.
Figure 15B:
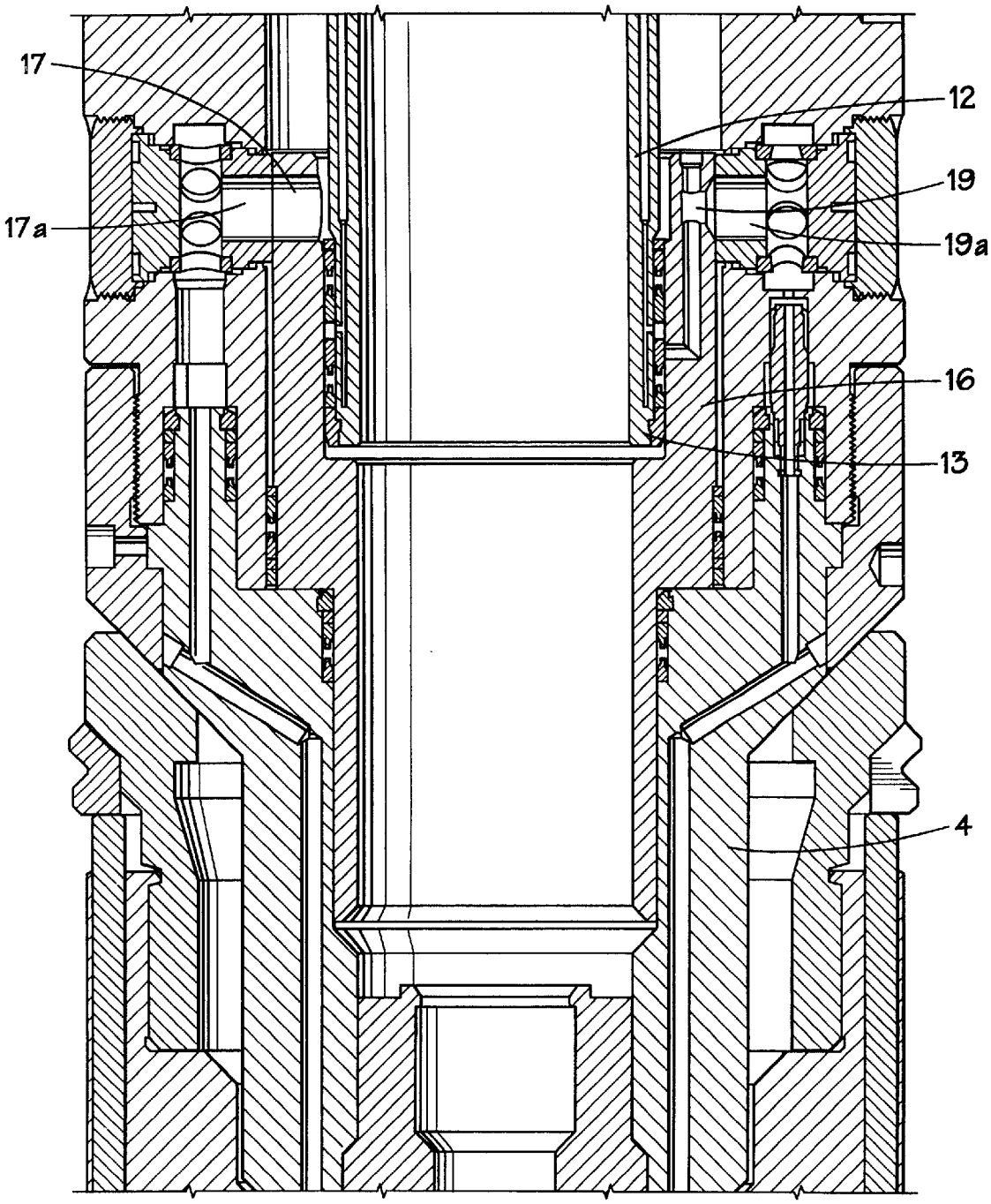
FIG. 15*b* depicts a cross sectional view of the CTS in the extend the crossover assembly stab into the tubing hanger sequence, in a second position.

As shown in FIG. 15*b*, shuttle valve 16 is in an open position. A first plurality of seals 180 inhibit fluid leakage between body 156 and hanger 4. Referring to 15*a* and 15*b*, second plurality of seals 182 in combination with seals 180 forms chamber 15, and may further inhibit fluid leakage. The seals may include a primary metal-to-metal seal and secondary elasomer or polymer seal, with retainers in between. In the open position (shown in FIG. 15*b*), chemical injection bore 17 is aligned with second chemical injection port 17*a*. Likewise, annulus access bore 19 is aligned with second annulus access port 19*a*. However, in some embodiments, one or both of annulus access bore 19 and chemical injection bore 17 is not lined up with its associated second port (17*a* and 19*a*) in the first (open) position.

Figure 25D:
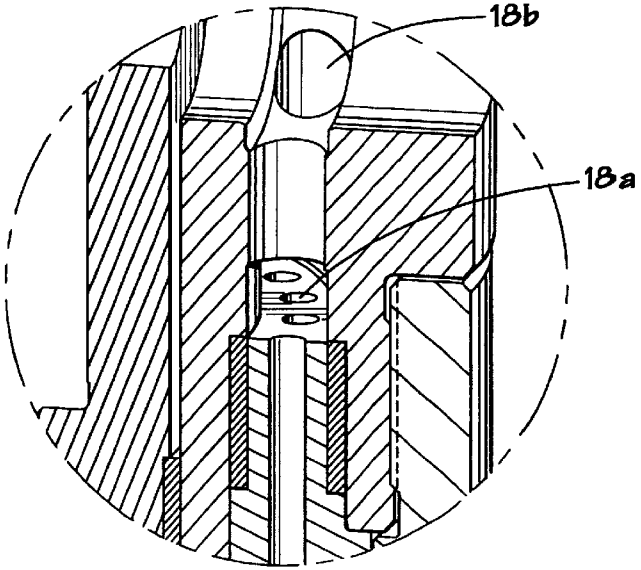
FIGS. 25*a*–25*c* depict details of the annulus flow paths.
Figure 25A:
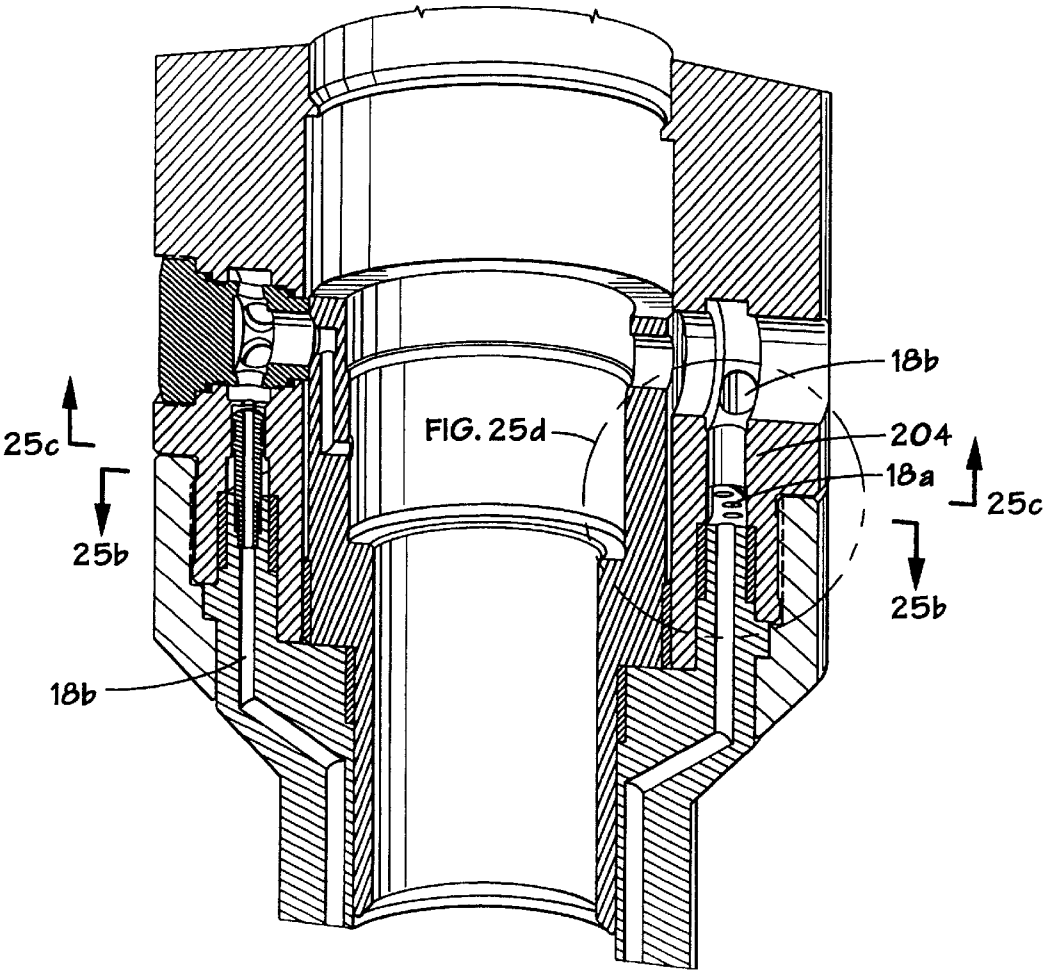
Figure 25B:
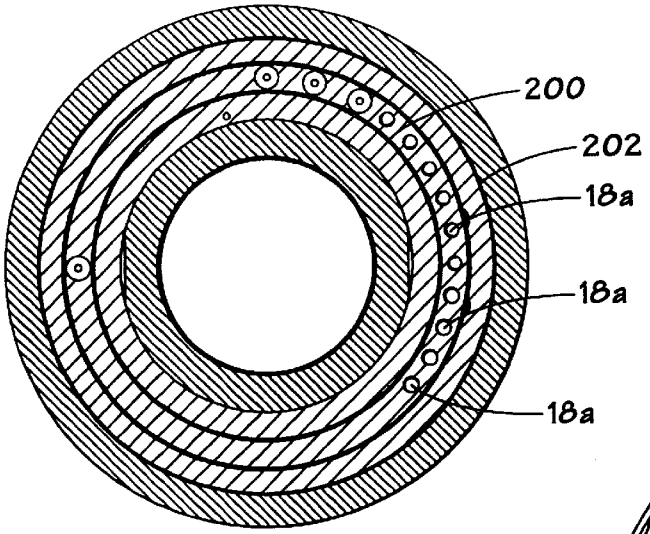
Figure 25C:
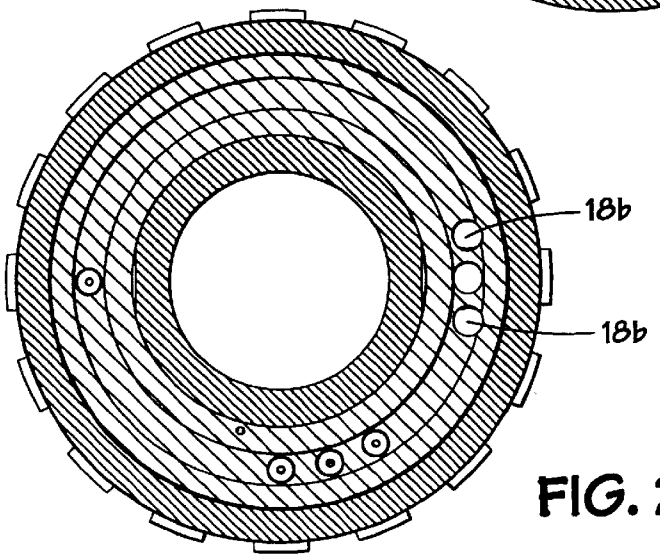
Figure 26:
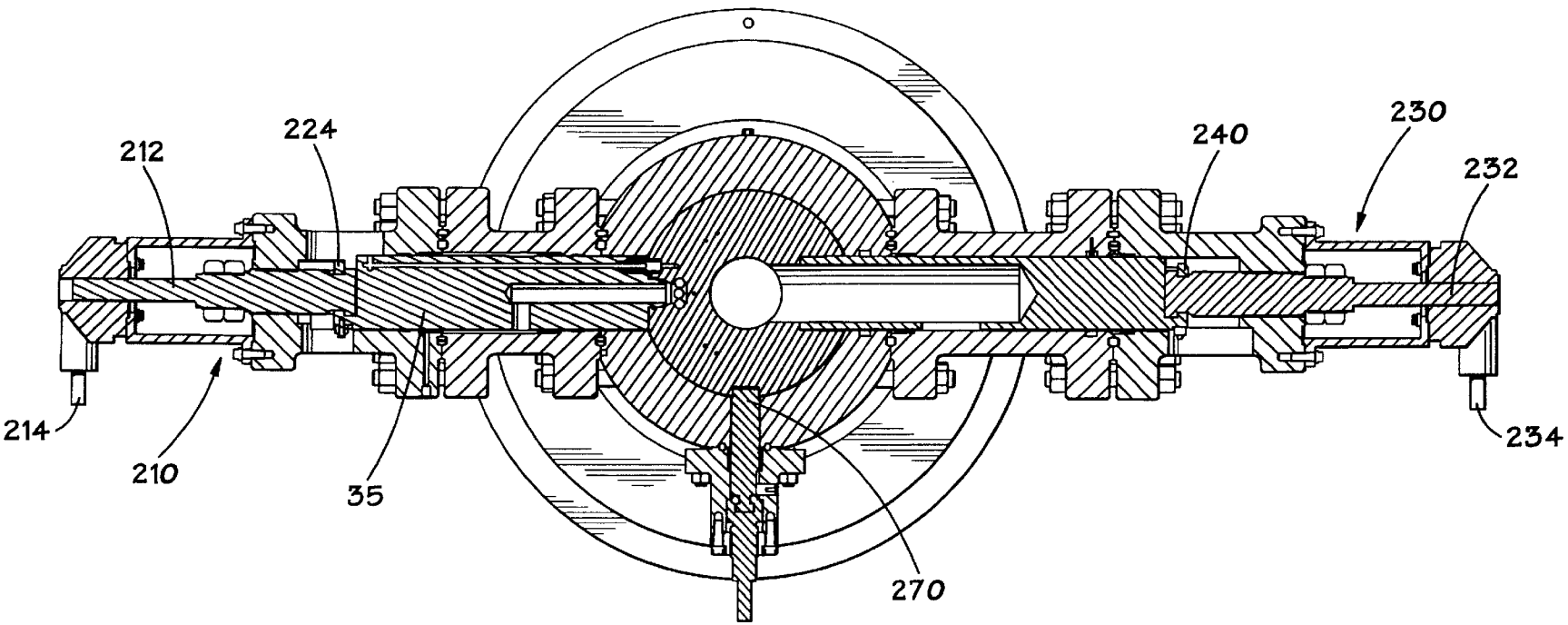
FIG. 26 depicts a cross-sectional top view of the CTS.
Figure 27:
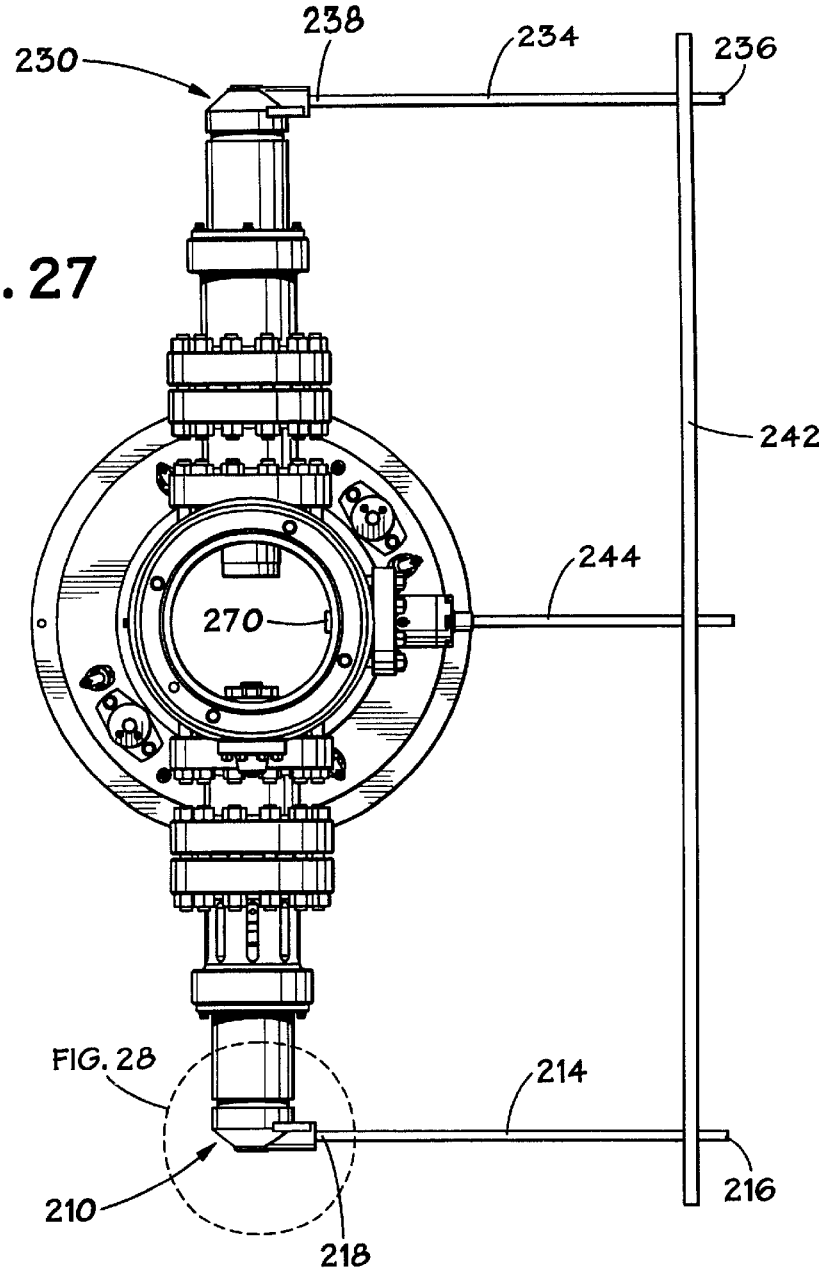
FIG. 27 depicts a top view of the CTS and retractable stab mechanism.
Figure 28:
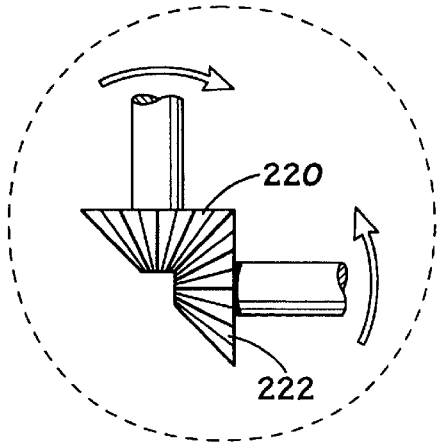
FIG. 28 depicts a detail of the bevel gears of the retractable stab mechanism.
Figure 29:
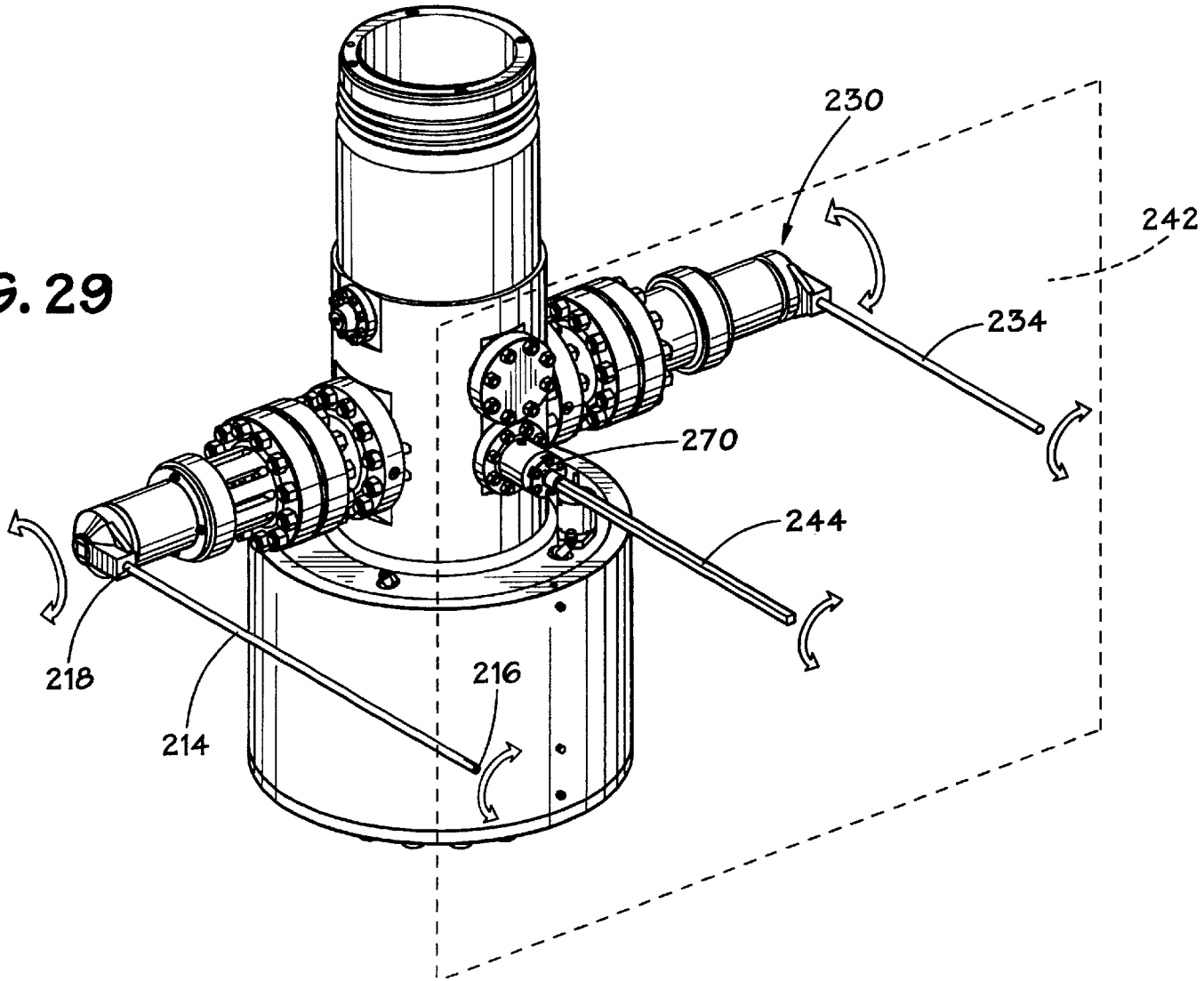
FIG. 29 depicts a perspective view of the apparatus according to FIG. 27.

Crossover stab 12 includes an annulus access channel 18 facilitating fluid communication to a downhole annulus 21 between the production tubing 7 and the innermost casing (tubing annulus not shown). Annulus access channel 18 is substantially longitudinal through tubing hanger 4, crossover stab 12, crossover assembly 10, and tree 2. Annulus access channel 18 is typical of a plurality of annulus access channels 18 shown in cross-section in FIGS. 25*a*–25*d*. In the section shown in FIGS. 25*a* and 25*b*, the first portion of annulus access channels 18 are designated 18*a* and are arranged interior to the crossover assembly between the interior wall 200 and the exterior diameter 202. The number and size of annular access channels 18*a* is a function of the flow capability desired. Typically the equivalent flow area of the combination of annulus access channels 18*a* is at least 1.5 inches, however this equivalent flow area may vary according to the particular operation. The equivalent flow area may be determined by operational standards to provide sufficient flow to, for example, kill a well with heavy fluids in the event of an emergency. Annulus access channels 18*a* converge to a common plenum 204 which provides for fluid communication from each of annulus access channels 18*a* to through another plurality of larger annulus access channels, for example the three larger annulus access channels 18b shown in FIGS. 25*a*, 25*c*, and 25*d*. FIG. 25*c* is a view in the upward direction of the section shown in FIG. 25*a*, which is in the opposite direction of same section shown in FIG. 25*b*. Annulus access channel 18*a* advantageously provides an equivalent flow area to operationally manage the well while also allowing for a single bore tubing hanger. Similar channels may be part of the crossover tree system to provide for chemical injection downhole, or to provide communication with downhole equipment such as pressure and temperature sensors. Those skilled in the art will appreciate that the disclosure of the annulus communication system is applicable to many other types of downhole communication. In the exemplary embodiment shown, chemical channels 23 extend through crossover assembly 10 to facilitate chemical injection into production tubing 7 in much the same way as annulus access channels 18. In the embodiment shown, the plurality of chemical channels 23 is provide a minimum flow area equivalent to a 0.375 inches bore, to provide adequate flow to the production bore as necessary. It will be understood by one of skill in the art with the benefit of this disclosure, however, that other equivalent flow areas deviating substantially in either direction from 0.375 inches can be obtained as required for the particular application.

Figure 16:
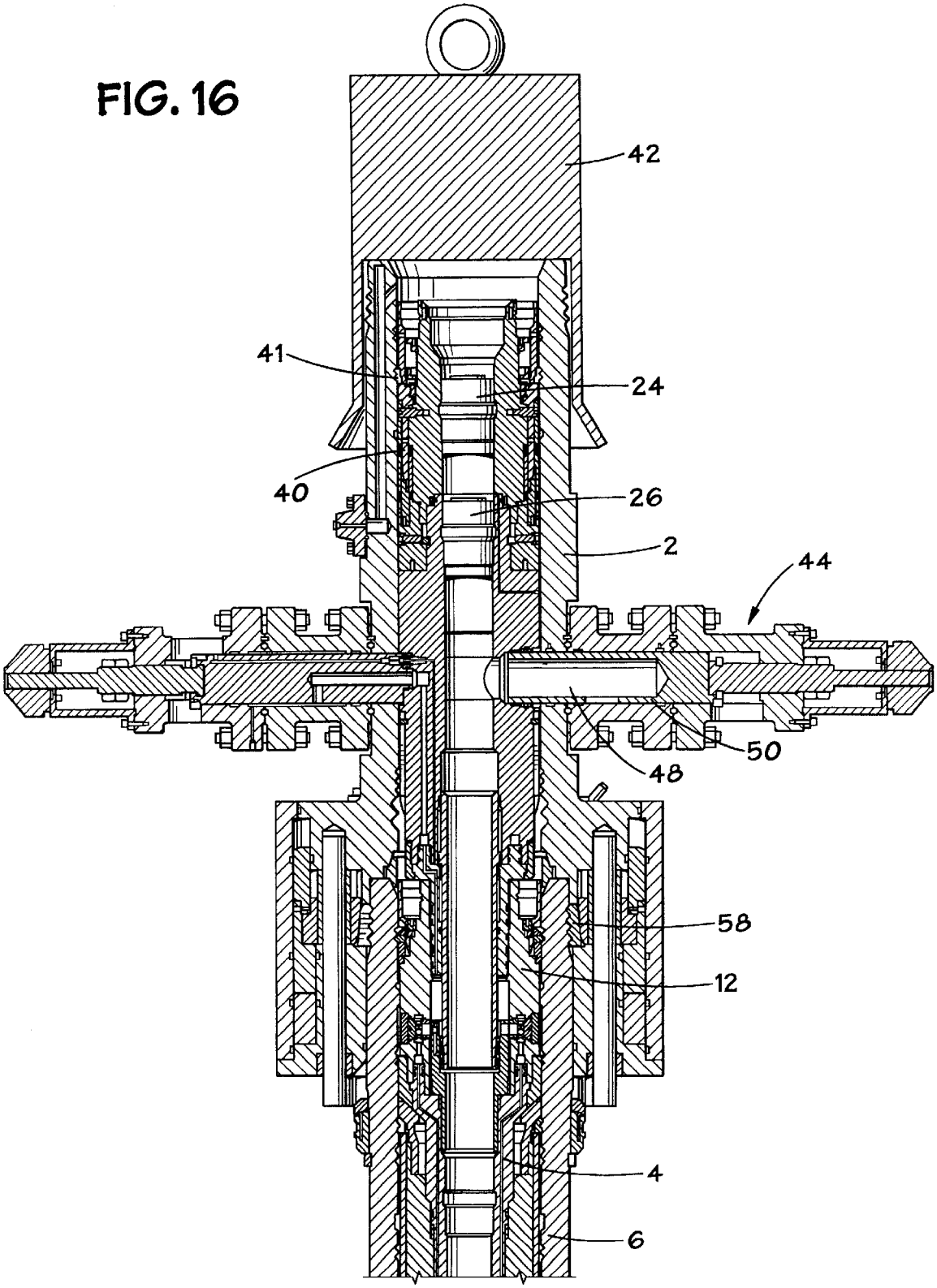
FIG. 16 depicts a cross sectional view of the CTS in the retrieve tubing hanger wireline plug/install crossover wireline plug/retrieve tree running tool/ROV install debris cap sequences.
Figure 17:
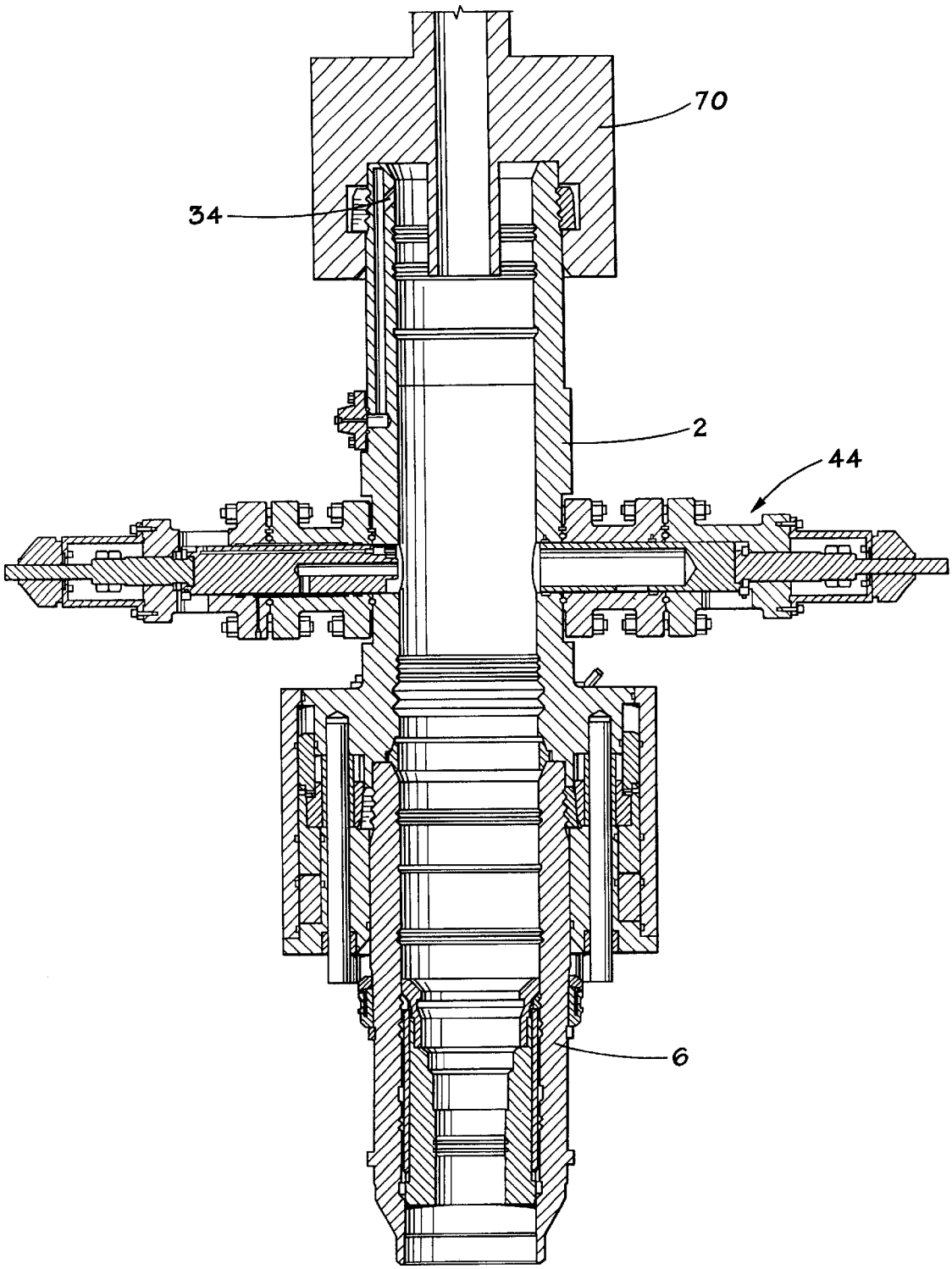
FIG. 17 depicts a cross sectional view of the CTS in the optional sequence of locking the empty spool body onto the wellhead with the tree running tool.
Figure 30:
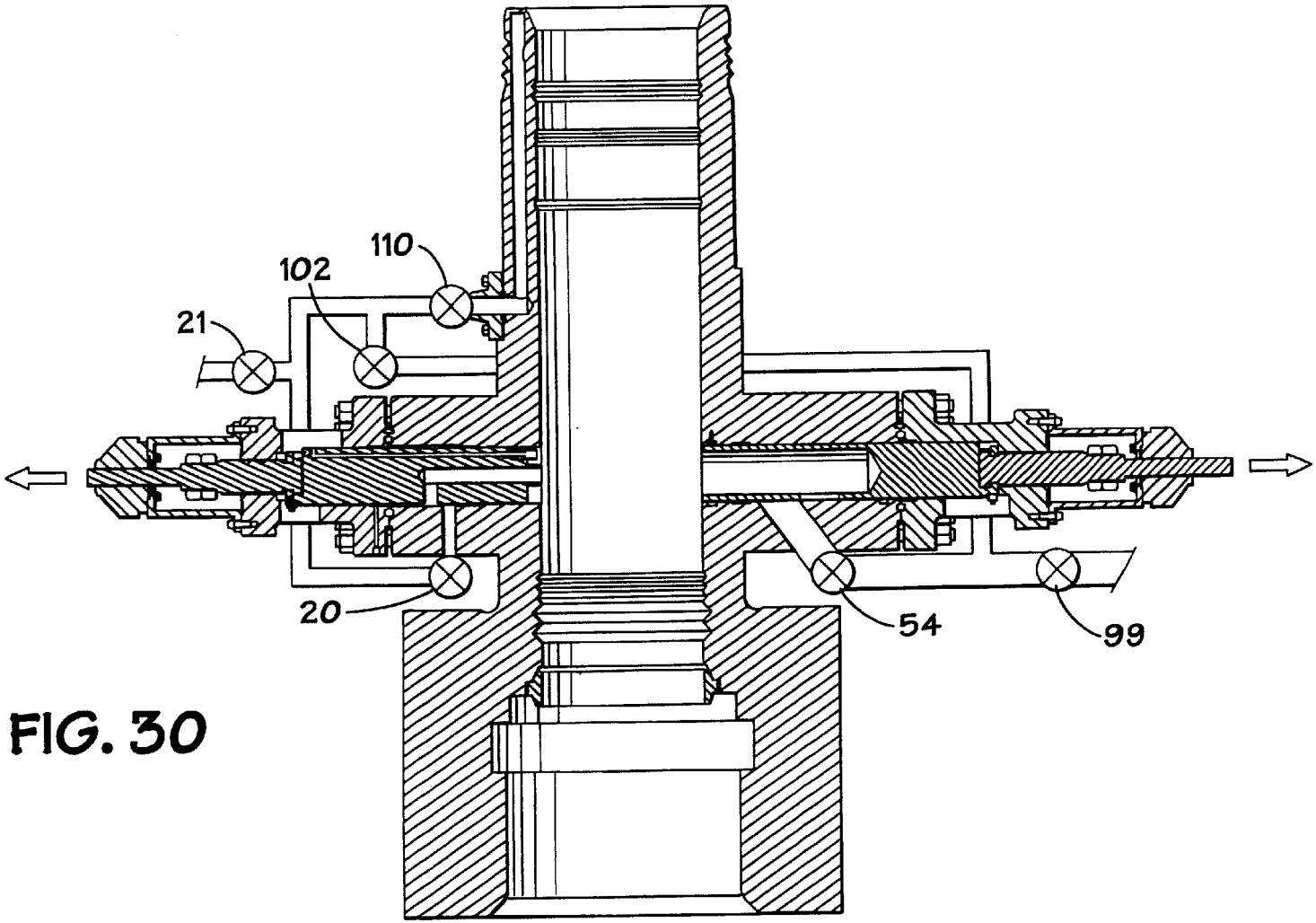
FIG. 30 is an alternative embodiment of the christmas tree.

One or more annulus valves 20 may isolate the sections of annulus access channel 18 between the tree 2 and the crossover assembly 10. Annulus valve 20 is shown in FIG. 1 exterior to the tree body, but it may be located anywhere along annulus access channel 18. A second annulus valve 21 may also be used as shown in FIGS. 1 and 16. While the annulus valves and piping are shown with flanged connections to the tree 2, other types of connections can be substituted, or portions of the annulus piping or valves may be integral to the tree body as shown in FIG. 30.

Annulus access channel 18 extends through a radial bore 32 in tree 2, continues outside the body of tree 2, then re-enters the body of tree 2 and continues substantially longitudinal with the proximal end of tree 2. A retractable radially extending annulus stab assembly 36 extends between radial annulus bore 32 in tree 2 and crossover assembly 10. The retractability of an annulus stab 35 advantageously allows for independent installation and retrieval of tubing hanger 4, crossover assembly 10, and the tree 2. Annulus access channel 18 terminates at a proximal annulus port 34 which facilitates fluid communication between the tubing annulus and the surface. While annulus port 34 is shown above the crossover assembly 10, it may be located adjacent or below the crossover assembly.

Figure 36:
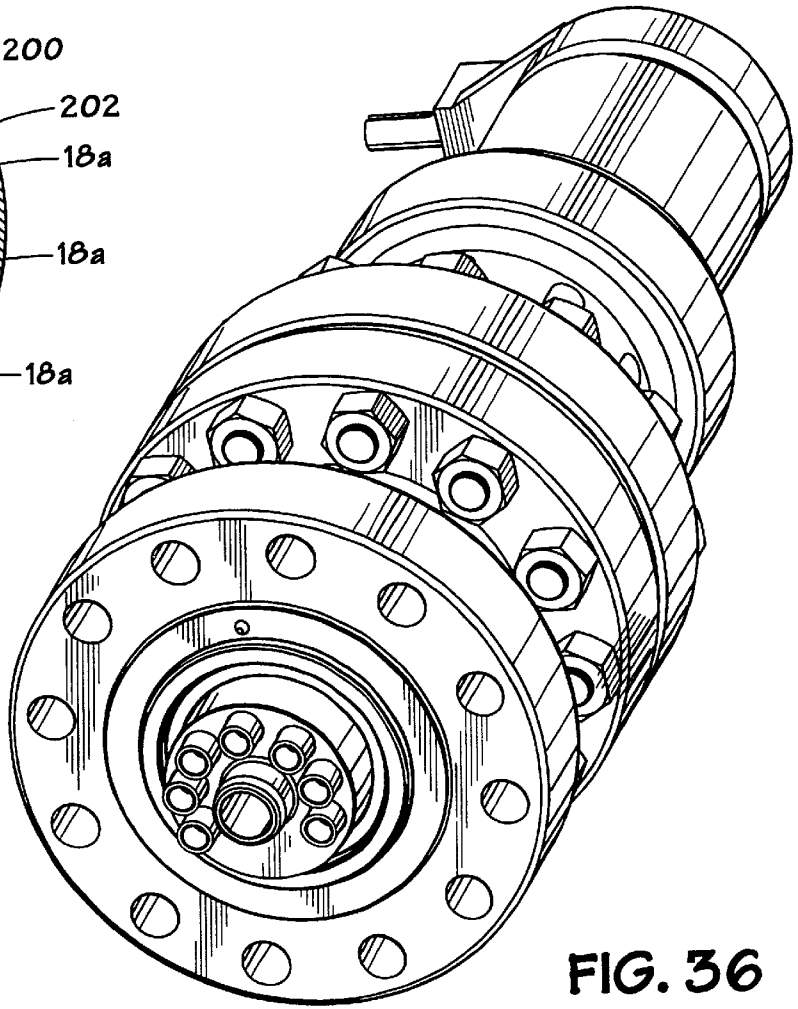
FIG. 36 depicts a perspective view of the annulus stab mechanism.

Annulus stab 35 may be operable by hydraulic or electric actuation, or it may be mechanically operated. In the embodiment shown, annulus stab assembly 36 is operated mechanically. The details of the annulus stab assembly 36 are found in FIGS. 26–29. For example, annulus stab 35 may be operable by ROV (not shown). The ROV may be a standard remote operated vehicle or it may be any other remotely operated vehicle. The ROV provides rotational movement to annulus stab mechanism 210 to extend and/or retract annulus stab 35 between crossover assembly 10 and tree 2. Annulus stab mechanism 210 shown in FIGS. 26–29 includes first and second shafts 212 and 214 extending from the annulus stab mechanism. Distal end 216 of second shaft 214 is adapted to connect to an ROV. Proximal end 218 of second shaft 214 is operatively connected to a pair of bevel gears 220 and 222 which are approximately 90 degrees out of phase with one another. Therefore, rotation of second shaft 214 is translated 90 degrees to rotate first shaft 212. In an alternative embodiment, first shaft 212 is rotated directly without the use of a second shaft or set of gears. First shaft 212 is connected to annulus stab 35. Annulus stab 35 includes an anti-rotation key 224 which prevents the annulus stab from rotating with first shaft 212. Therefore, as first shaft 212 rotates, the rotational movement is translated via the connection with annulus stab 35 into strictly axial movement of the annulus stab. Upon connection between second shaft 214 and the ROV, rotation of the second shaft may ultimately accomplish the extension or retraction of annulus stab 35 into and/or out of engagement with crossover assembly 10. Alternatively, annulus stab 35 may be hydraulically or electrically extended and retracted (not shown). FIG. 36 shows in perspective view the annulus stab mechanism 36.

Figure 34:
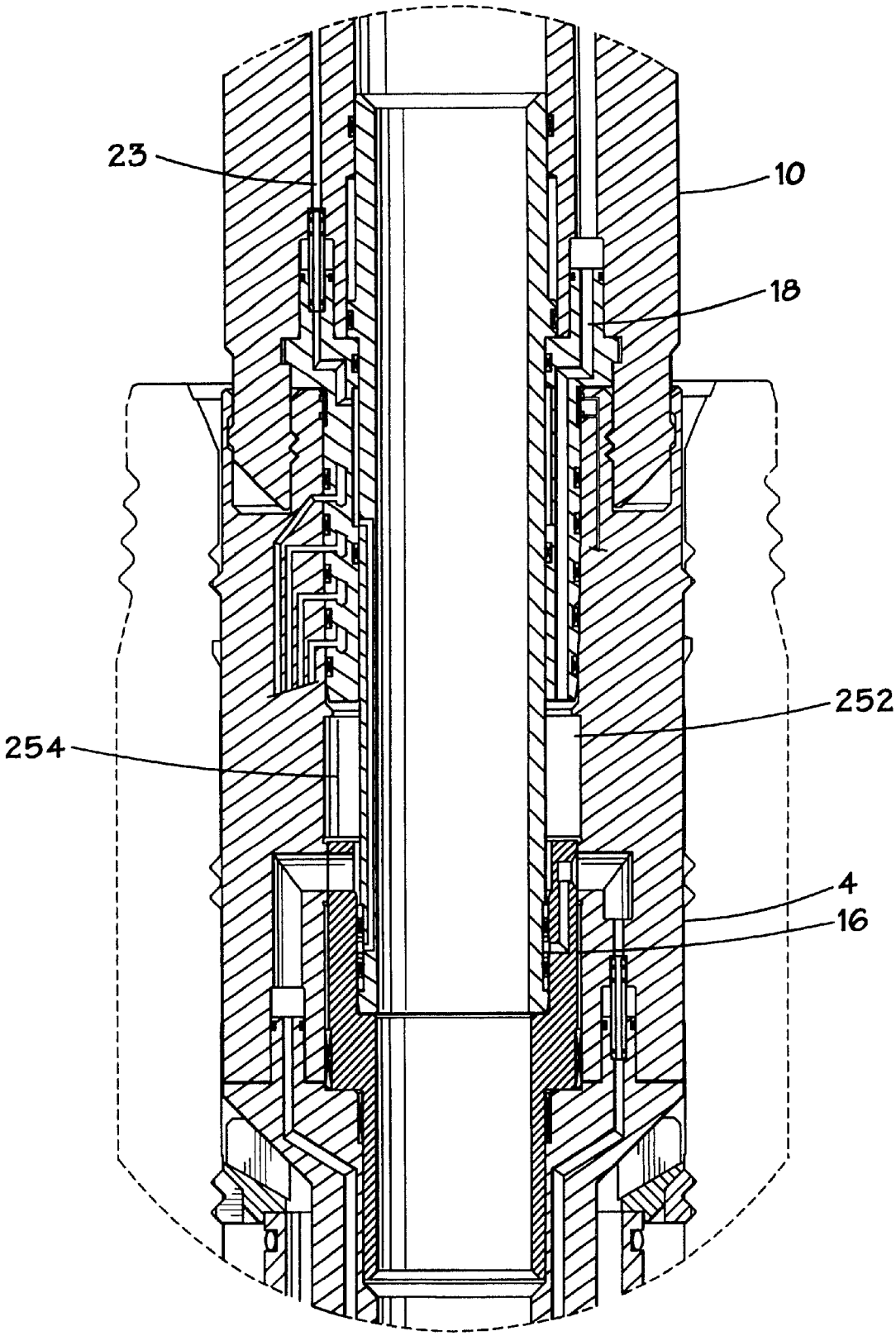
FIGS. 34–35 depict a detail of the crossover assembly/hanger interface.

As shown in FIG. 34, crossover stab 12 also includes a downhole safety valve control port which is in communication with a safety valve access channel 94 through crossover stab 12.

Figure 5:
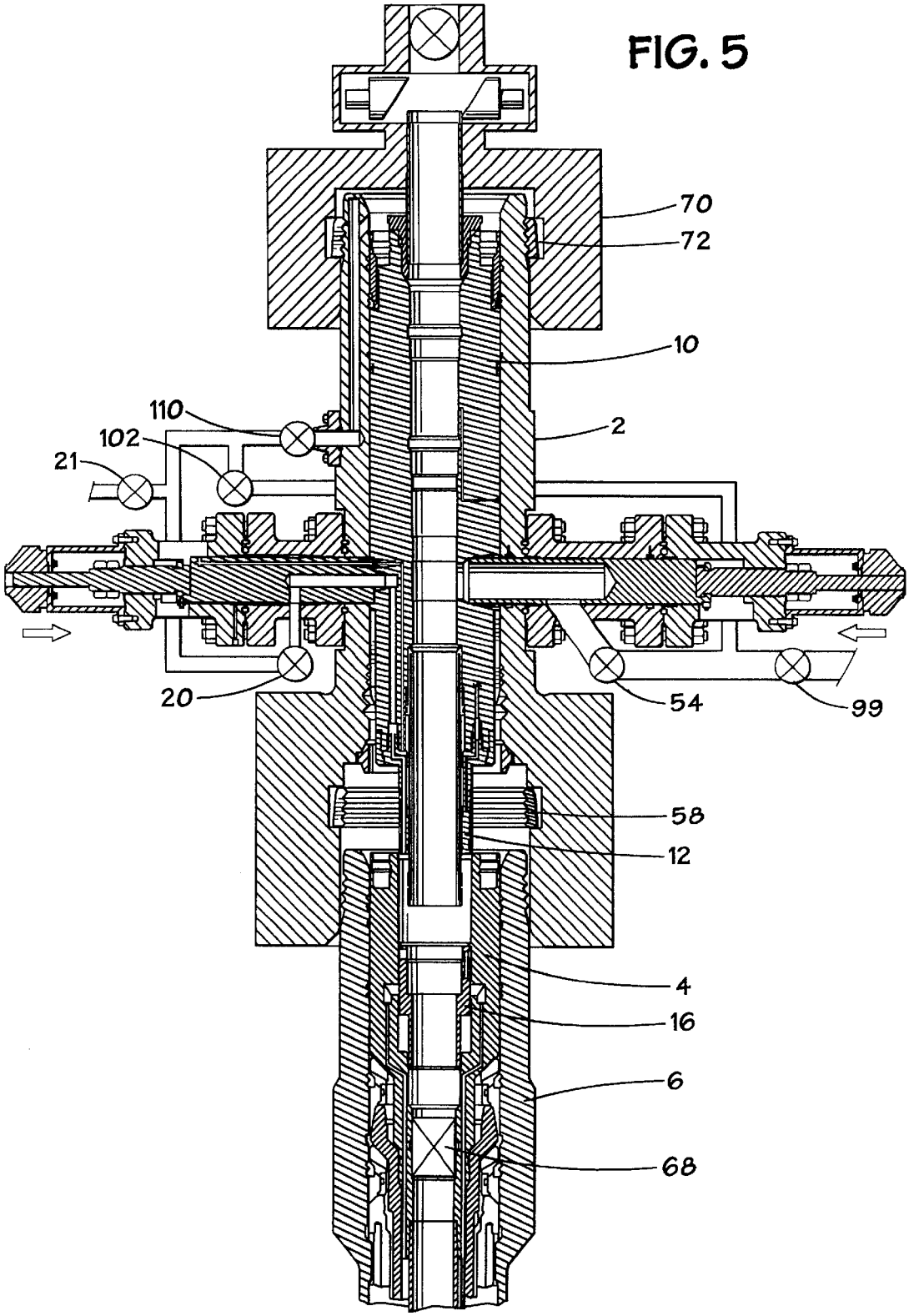
FIG. 5 depicts running the tree with the tree fully assembled.

As shown in FIG. 5, a crossover seal 38 seals the annulus between crossover assembly 10 and tree 2 and may serve as a primary barrier to any possible leaks across crossover assembly 10. Seal 38 may be comprise metal-to-metal sealing elements or may comprise resilient sealing elements, or a combination of both. Seal 40 may act as a secondary barrier.

Figure 21:
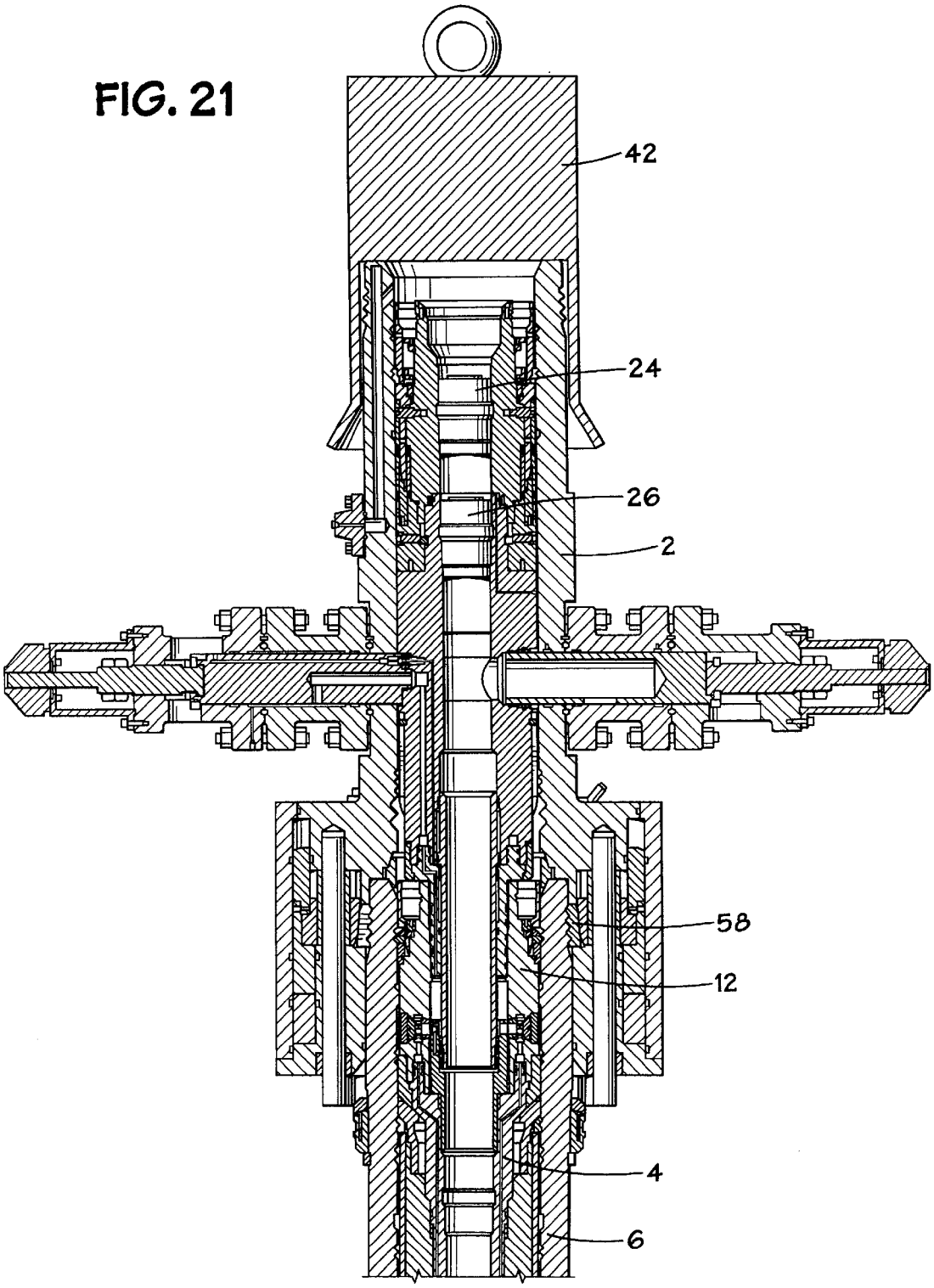
FIG. 21 a cross sectional view of the CTS in the optional sequences of retrieving the tubing hanger plug, installing crossover plugs, retrieving the BOP stack, and ROV installing the debris cap.

In the embodiment of FIG. 1, a wireline plug 24 is disposed within crossover assembly 10. A second wireline plug 26 is also disposed within crossover assembly 10. Wireline plugs 24 and 26 provide a multi seal between the production fluids entering crossover assembly 10 , and cap assembly 42. Plugs 24 and 26 may comprise mechanical or hydraulic plugs, may be retrievable using wireline, coiled tubing, or pipe, or may be valves or other closures which are known in the art. In the embodiments of FIGS. 10, 16 and 21, both closures are installed in crossover assembly 10.

At least a portion crossover assembly 10 and tubing hanger 4 are located radially interior to tree 2. Crossover assembly 10 has associated lock down ring 30 to position the crossover assembly securely within tree 2 and to prevent dislocation after the assembly is landed and locked.

In one embodiment, tree 2 includes a radially extending production stab assembly 44. Production stab assembly 44 extends through a tree bore 46, which is aligned with a crossover bore 48 in crossover assembly 10. A production stab 50 extends between crossover bore 48 and tree bore 46 in the position shown in FIG. 1. A plurality of production seals 53 seal between the production stab 50 and bores 46 and 48. Production stab 50 is retractable as described below. One or more production valves, such as valve 54 shown, may be attached to production stab assembly 44 to control the flow of produced hydrocarbons. FIG. 10 shows a general arrangement including production master valve (PMV) 54 and production wing valve (PWV) 99. One or more of valves 54 and 99 may be flanged and bolted to the tree 2, as is shown for valve 54 in FIG. 1, or one or more of the valves may be integral to a valve block or to the tree body as shown in FIG. 30. The embodiment of FIG. 2 shows production valve 54 adjacent production stab assembly 44, but it will be understood that production valve 54 may be integral to the production stab assembly as shown in FIG. 30.

Figure 22:
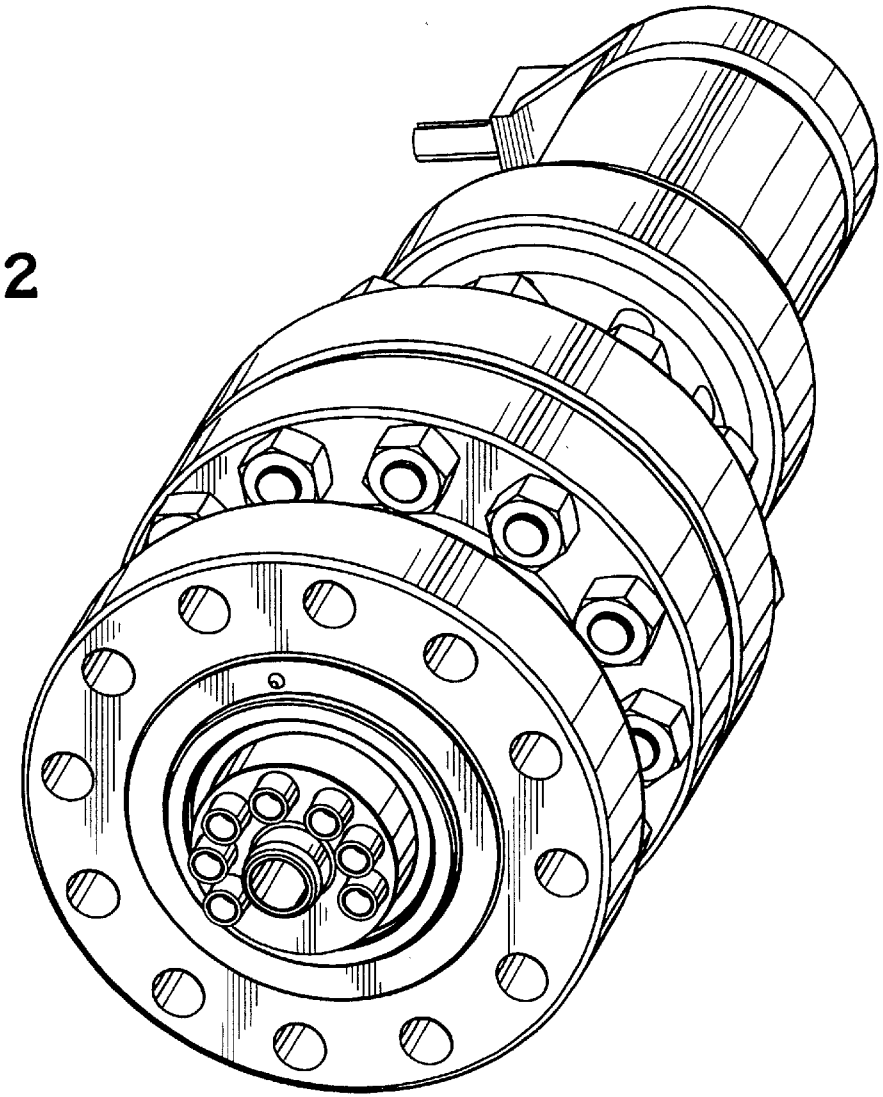
FIG. 22 depicts a combination detail of the side stabs.

Similar to annulus stab 35, production stab 50 may be operable by hydraulic or electric actuation, or it may be mechanically operated. In the embodiment shown, production stab 50 is operated mechanically. For example, production stab 50 may be operable by an ROV (not shown). The ROV provides rotational movement to a production stab mechanism 230 to extend and/or retract production stab 50 between crossover assembly 10 and tree 2. Production stab mechanism 230 shown in FIGS. 26–29 includes first and second shafts 232 and 234 extending from the production stab mechanism. Distal end 236 of second shaft 234 is adapted to connect to an ROV. Proximal end 238 of second shaft 234 is operatively connected to a pair of bevel gears 220 and 222 which are approximately 90 degrees out of phase with one another. Therefore, rotation of second shaft 234 is translated 90 degrees to rotate first shaft 232. In an alternative embodiment, first shaft 232 is rotated directly without the use of a second shaft or set of gears. First shaft 232 is connected to production stab 50. Production stab 50 includes an anti-rotation key 240 which prevents the production stab from rotating with first shaft 232. Therefore, as first shaft 232 rotates, the rotational movement is translated via the connection with production stab 50 into strictly axial movement of the production stab. Upon connection between second shaft 234 and the ROV, rotation of the second shaft may ultimately accomplish the extension or retraction of production stab 50 into and/or out of engagement with crossover assembly. Alternatively, production stab 50 may be hydraulically or electrically extended and retracted (not shown). Second shafts 234 and 214 may extend through a standard ROV panel 242, along with an alignment pin shaft 244. FIG. 22 shows in perspective view the annulus stab mechanism 36.

Figure 12:
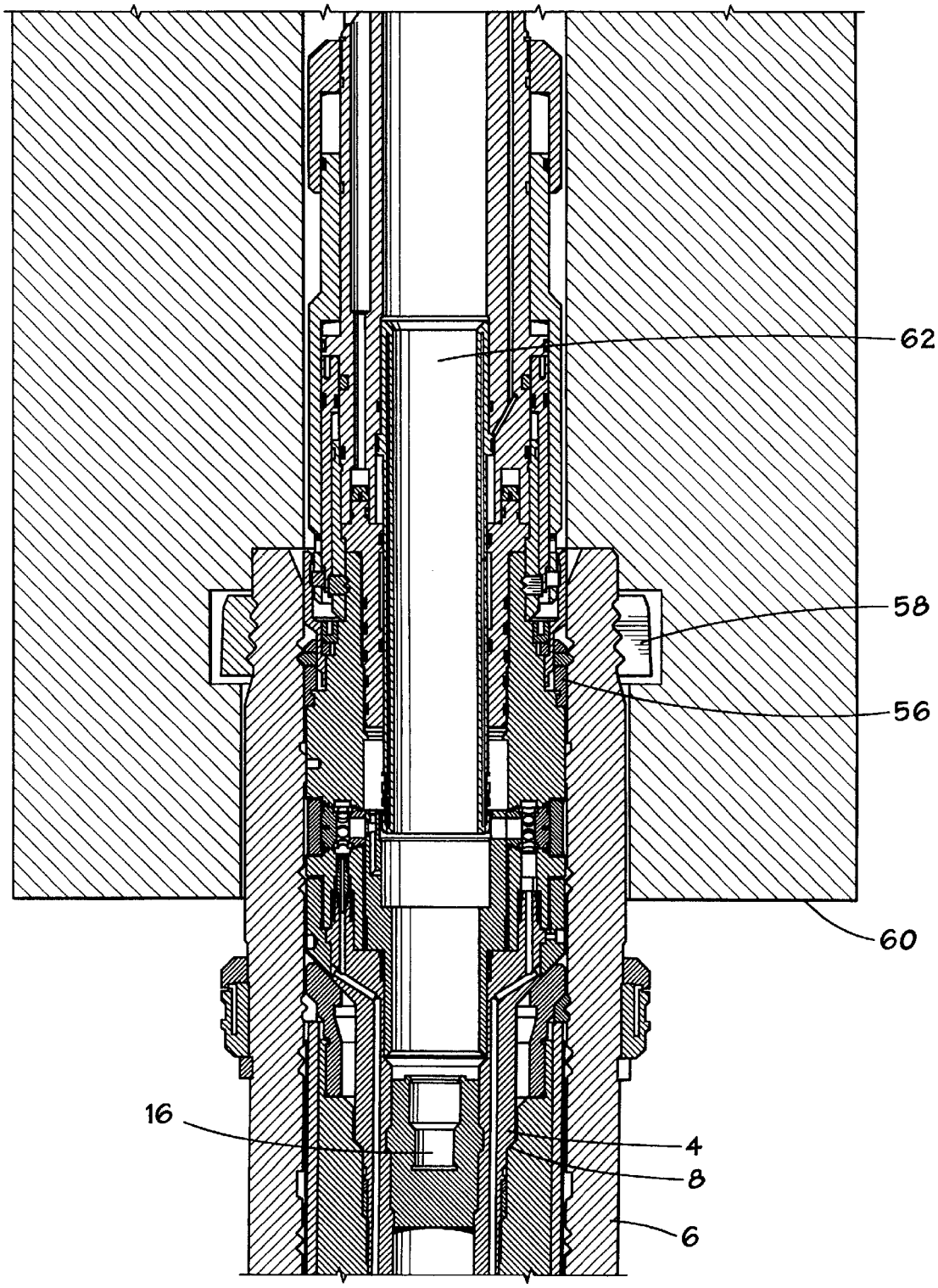
FIG. 12 depicts a cross sectional view of the CTS tubing hanger in the initial sequence positions.
Figure 39:
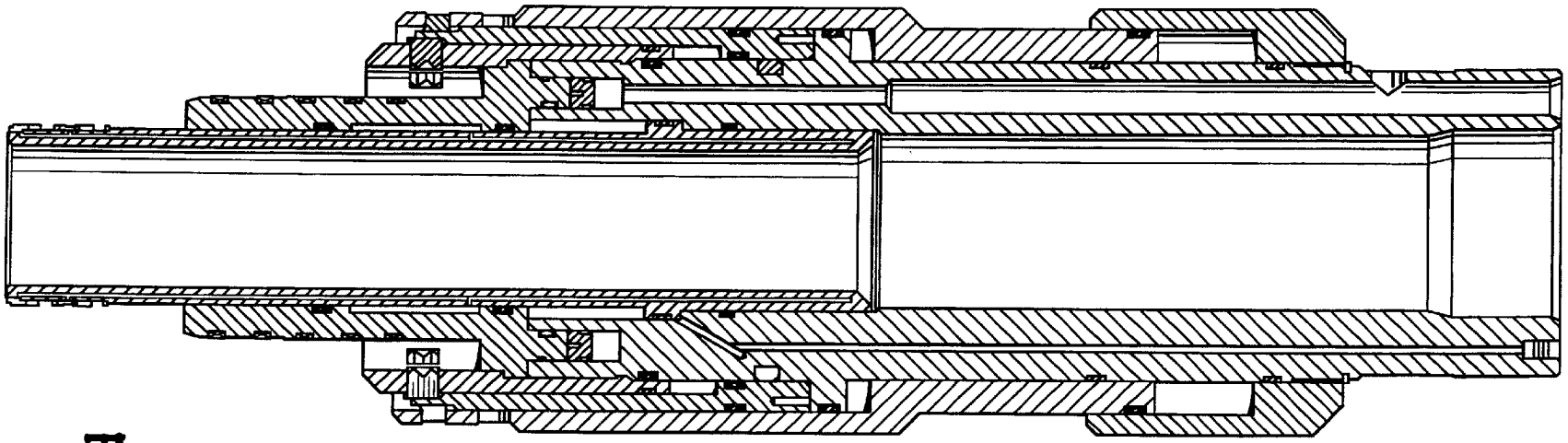
FIG. 39 depicts a multiple use running tool.

With the assembly as shown in FIG. 1, production fluids may enter tubing hanger 4 from the wellbore and continue through a portion of crossover assembly 10. The production fluids are then directed through crossover bore 48 as wireline plug 26 inhibits further progression up through crossover assembly 10. Production fluids continue through tree bore 46 via the sealed conduit provided by production stab 50, and into the radially extending production stab assembly 44. When production valve 54 is open, production fluids then continue into a flow line 246 for further transportation to a desired location. An operator also has access, according to the embodiment shown in FIG. 1, to the annulus of the wellbore tubing through annulus access channel 18. The access to the annulus may be important, for example, to allow an operator to circulate fluids, to relieve pressure in the annulus, or to bullhead the well for example. Should there be any leakage past wireline plug 26, wireline plug 24 prevents further leaking. Referring next to FIG. 2, one of many sequences of installation, retrieval, or workover that are possible in accordance with the invention is described. FIGS. 2 and 12 depict the installation and/or retrieval of tubing hanger 4 within wellhead 6. Generally, tubing hanger 4 is installed while a blowout preventor (BOP) stack 60 is attached to wellhead 6 or to the tree 2. BOP stack 60 is conventional and well known to one of skill in the art with the benefit of this disclosure. Referring to FIG. 3, with BOP stack 60 in place, tubing hanger 4 and running tool stab 113 are inserted into or retrieved from wellhead 6. Running tool stab 113 is in the working or down position as shown in FIGS. 3 and 12. Tubing hanger 4 and running tool stab 113 are attached to a multi purpose running tool 62. Multi purpose running tool 62 is also shown in FIG. 39.

Figure 2:
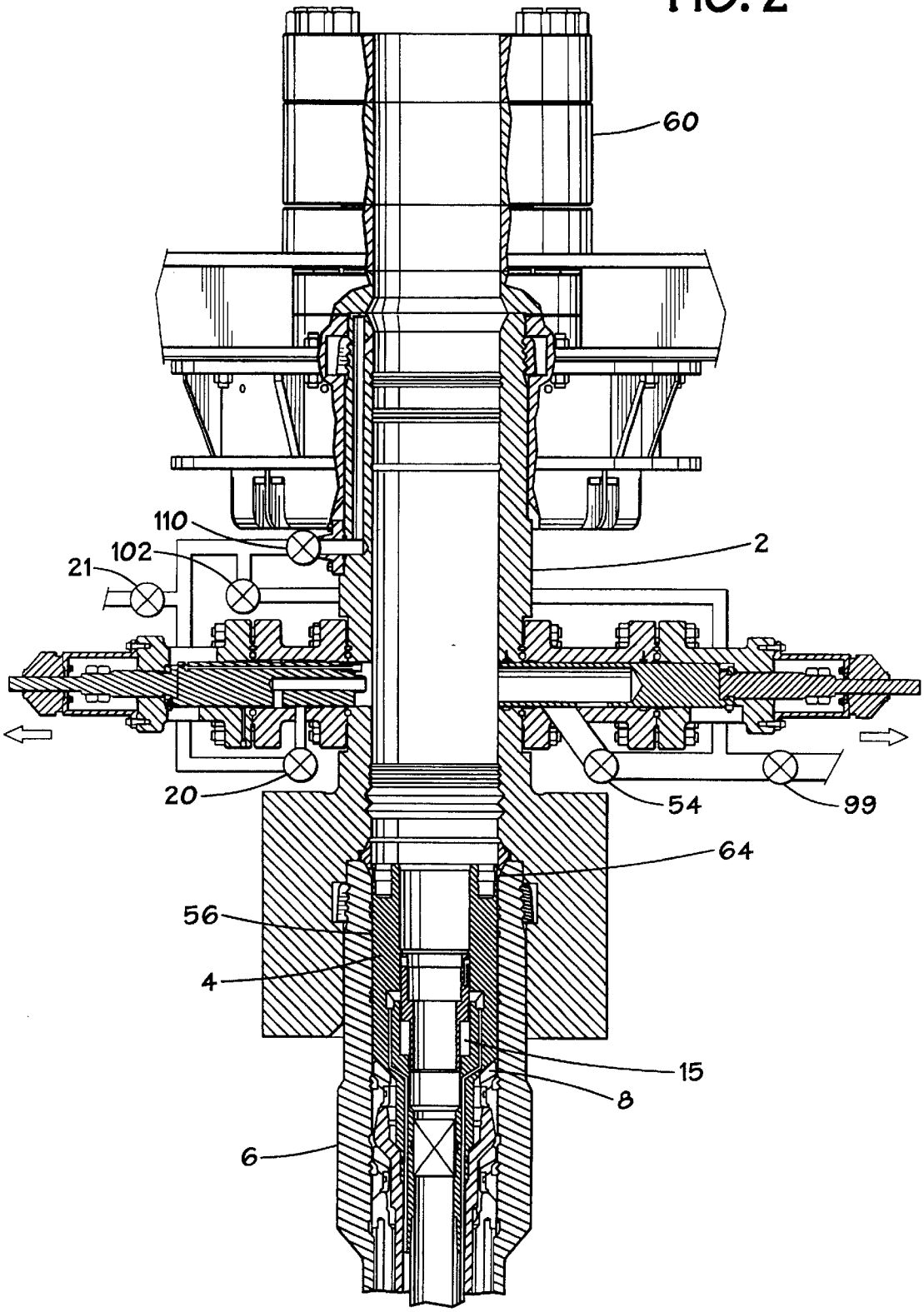
FIG. 2 depicts the tubing hanger access through the tree.
Figure 3:
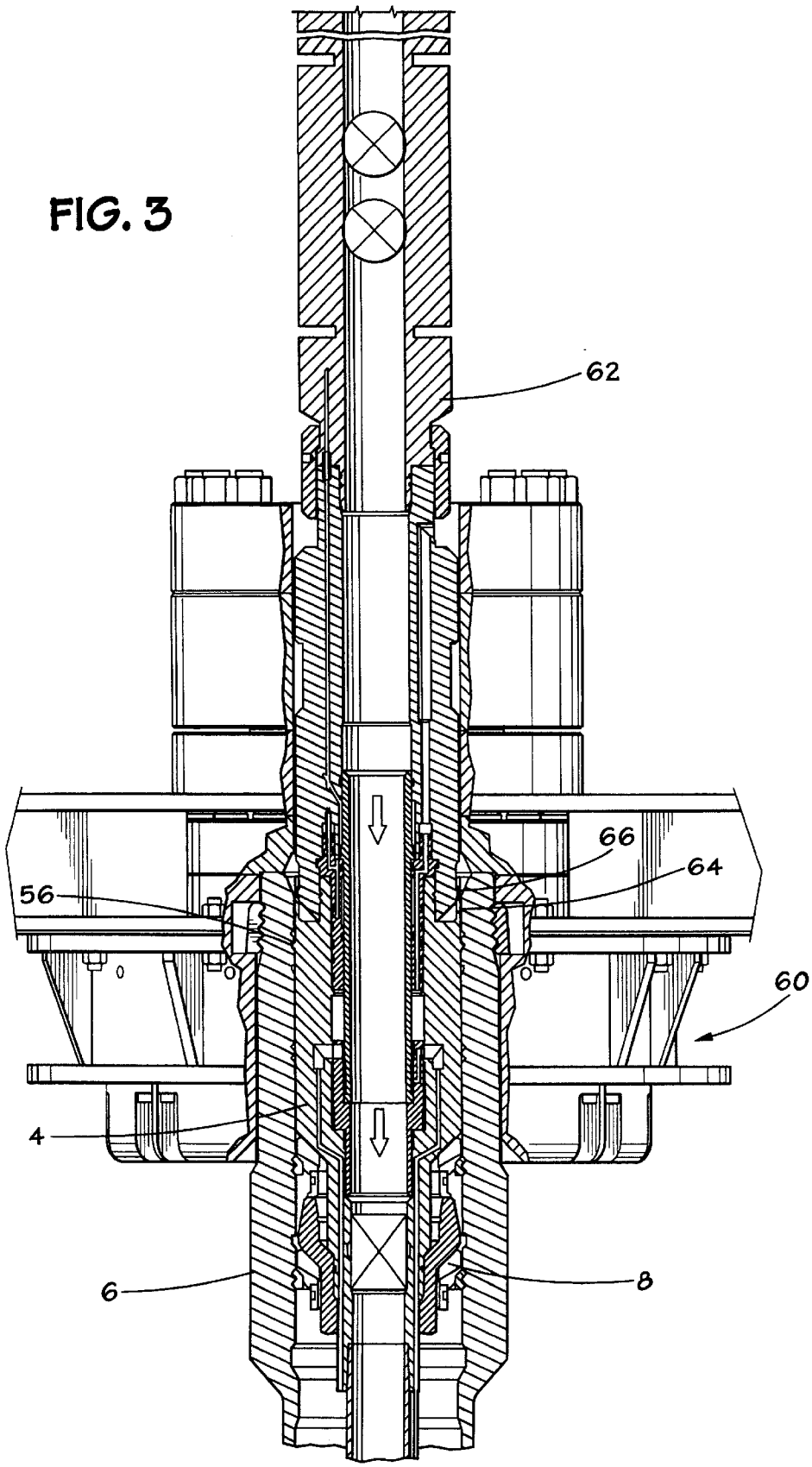
FIG. 3 depicts the installation/retrieval of the tubing hanger without the tree installed.

In FIG. 2, the christmas tree 2 has also been installed and only the tubing hanger has been installed without the crossover assembly. When tubing hanger 4 is being installed, the hanger continues downhole via multi purpose running tool 62 until it engages wellhead shoulder 8. As shown in FIG. 12, when tubing hanger 4 engages wellhead shoulder 8, tubing hanger lockdown ring 56 locks the hanger in place and multi purpose running tool 62 may be returned to surface.

Figure 4:
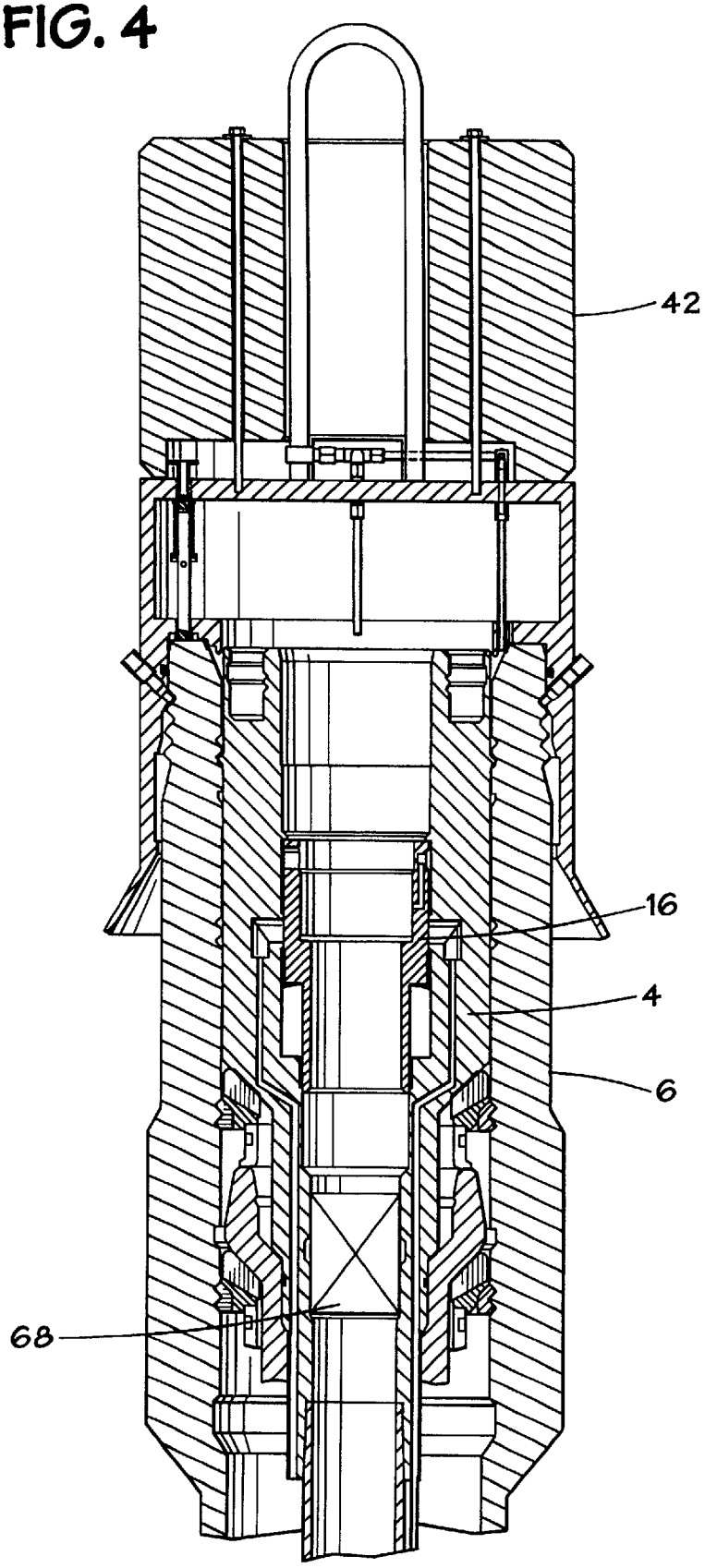
FIG. 4 depicts the tubing hanger in the wellhead and temporarily abandoned.

Referring next to FIGS. 3 and 4, with tubing hanger 4 positioned within wellbore 6, pressure is applied through the running tool stab 113 allowing the sliding valve 16 to be in the closed or up position. A wireline plug 68 or other closure is set inside the tubing hanger through the tubing hanger running tool central bore, which runs through the BOP stack 60. The tubing hanger running tool and the BOP stack are then retrieved and a temporary abandonment/debris cap assembly 42 is installed and attached to wellhead 6 in the position shown in FIGS. 3 and 13. Tubing hanger sliding valve 16 is in the up or sealed off position in this sequence to prevent flow through the annular access or chemical injection porting, as the assembly awaits the installation of tree 2.

Referring next to FIG. 5, the temporary abandonment/debris cap assembly 42 and wireline plug 68 have been removed and fully assembled tree 2 is installed. In the sequence step shown in FIG. 5, tree 2 is run on tree running tool 70 with crossover assembly 10, crossover stab 12, and plug 68 in place inside tubing hanger 4. Crossover stab 12 is in the up or running position and tubing hanger sliding valve 16 is in the up or sealed position, which seals off the tubing annulus communication, as well as the downhole communication to chemical injection lines at the sliding valve 16. Tree running tool 70 is attached to the exterior of tree body 2 via tree running tool lock down ring 72. The complete tree assembly 2 is run until tree connector lock down ring 58 engages with wellhead 6 and the tree is secured in the position shown in FIG. 6.

Figure 6:
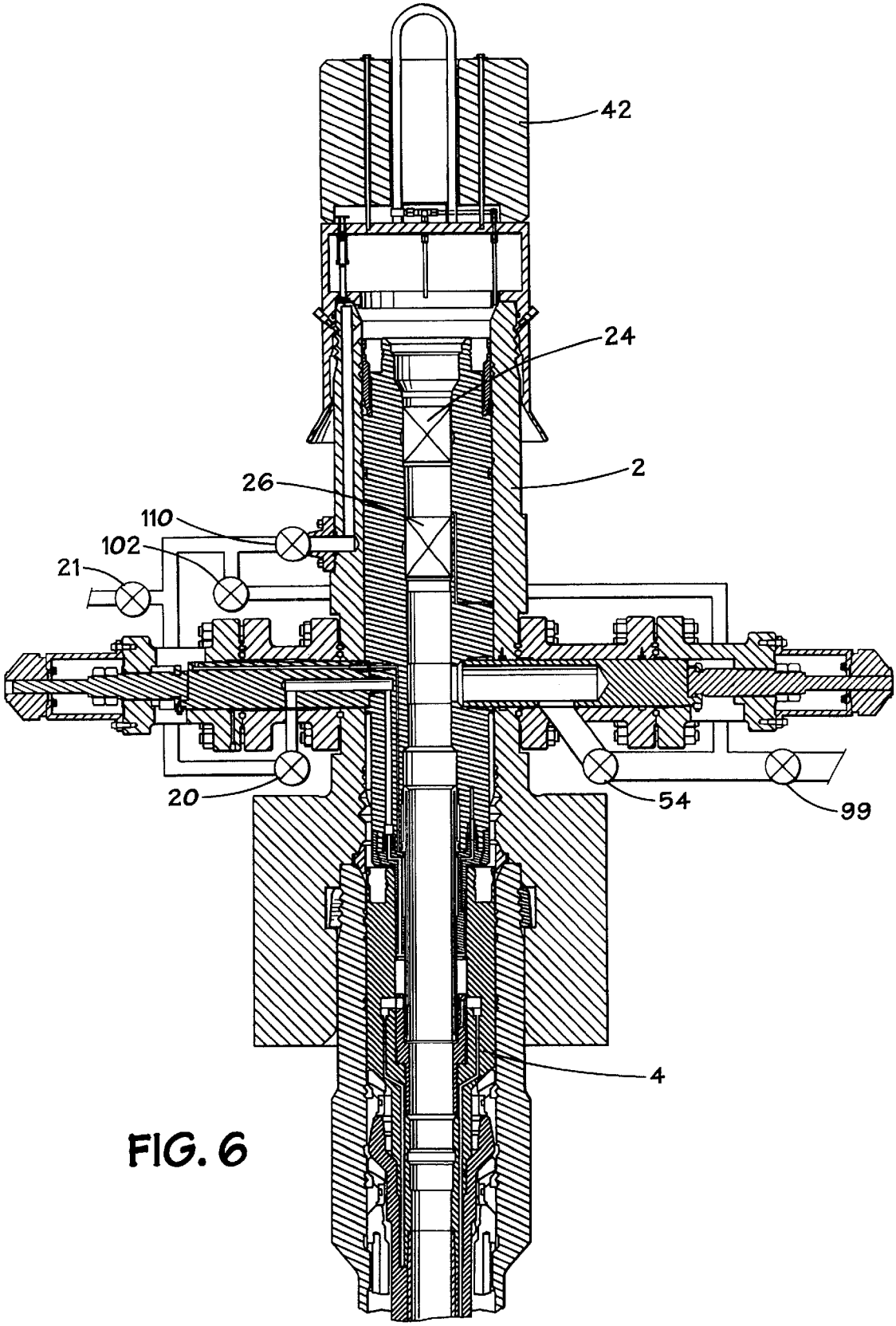
FIG. 6 depicts the installed and operational tree.

Referring to FIG. 6, tree assembly 2 is shown inproduction mode.

The preparation for retrieval of crossover assembly 10 comprises reinstalling BOP stack. In the sequence shown in FIG. 7, the debris cap 42 has been removed prior to the BOP stack 60 being run in and locked down. The BOP 60 is installed and connected to the proximal end of tree 2. BOP lock down rings 74 are engaged with tree 2 at the proximal end of the tree. If any wireline plugs have been set in the crossover assembly they may be retrieved and wireline plug 68 inside tubing 4 is set, in preparation for retrieving crossover assembly 10.

Figure 7:
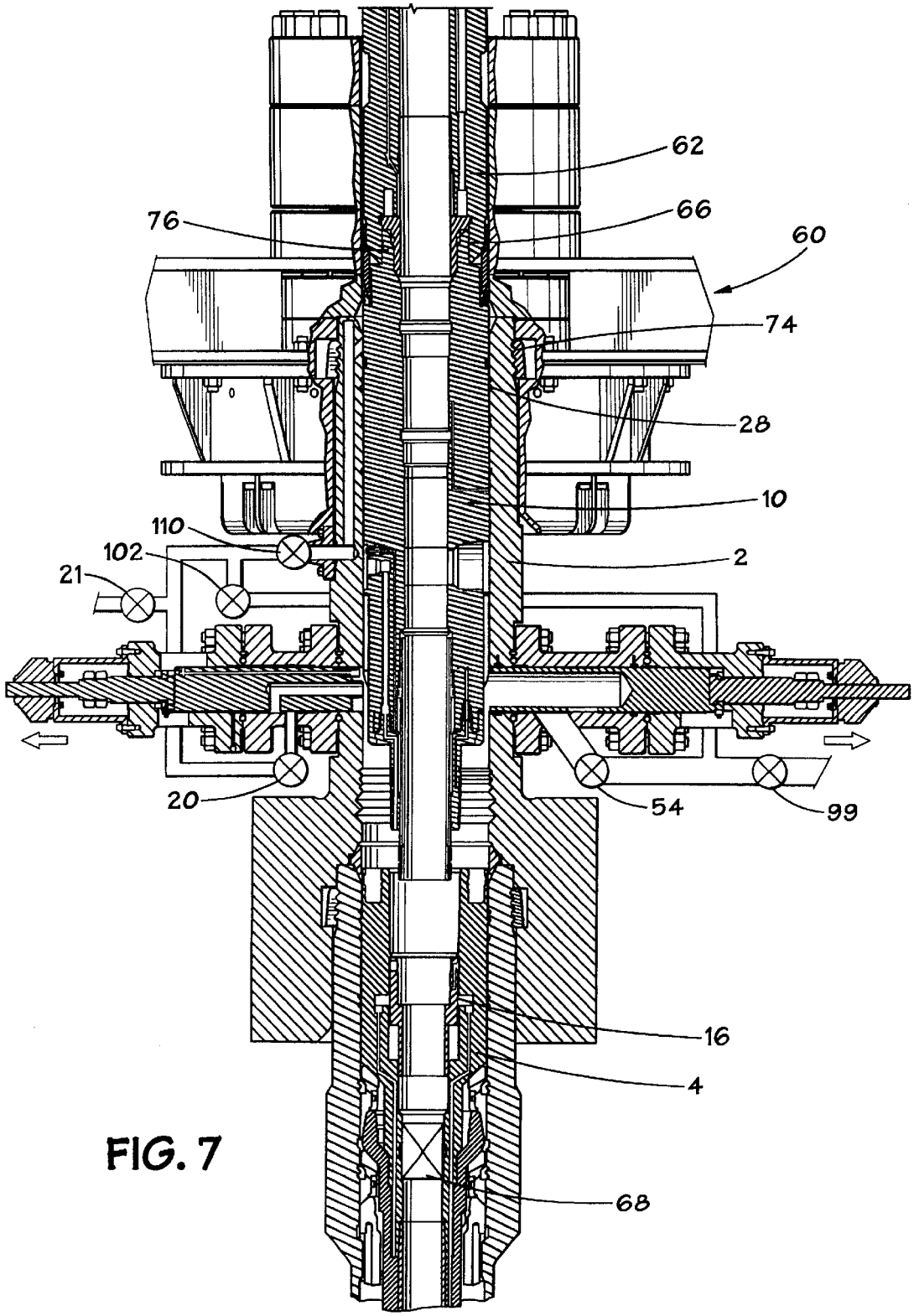
FIG. 7 depicts the installation/retrieval of the crossover assembly.

As shown in FIG. 7, the multi purpose running tool 62 may be inserted through BOP stack 60 to retrieve crossover assembly 10. Multi purpose running tool is shown attached to crossover assembly 10. In the embodiment shown in FIG. 19*b*, the attachment between crossover assembly 10 and multi purpose running tool 62 is facilitated by crossover lifting grooves 76 engaged with dogs 66 of multi purpose running tool 62. Crossover assembly lifting grooves 76 may be mounted on an exterior surface of crossover assembly 10 as shown in FIG. 19*b*. With the multi purpose running tool 62 attached to crossover assembly 10, the crossover assembly may be either retrieved or installed. As shown in FIG. 7, when crossover assembly 10 is installed, its operational position relative to tree 2 is maintained by crossover assembly lock down ring 28, which is engageable with tree 2 as discussed above. In addition, during installation and retrieval of crossover assembly 10, crossover stab 12 is in the up or installation/retrieval position as shown.

Referring to FIG. 19*b*, the engagement of lifting grooves 76 and dogs 66 constitute one mechanism of attachment between crossover assembly 10 and running tool 62. Other alternative attachment mechanism may be used. During installation and retrieval of crossover assembly 10, sliding sleeve 16 is in the up or installation/retrieval position as shown. In addition, production stab 50 and annulus stab 35 are retracted before installation or retrieval proceeds. The retraction of the production stab 50 and annulus stab 35 is accomplished by a mechanical ROV in the preferred embodiment, but other means for actuation including, but not limited to, hydraulic and/or electric, may be used. [If a hydraulic system is used, production stab 50 and annulus stab 35 may be normally biased to the retracted positions with the extension of each accomplished by hydraulic fluid. Alternatively, production stab 50 and annulus stab 35 may be motivated to their respective extended and retracted positions with hydraulic pressure without a bias. Hydraulic control lines (not shown) extending to sealed void areas between the stab assembly 44 and the production stab 50, or between the annulus stab 35 and the annulus piping, are one means of such control. In a preferred embodiment, one set of hydraulic lines will control both sets of stabs. Preferrably, production stab 50 and annulus stab 35 may be actuated by mechanical means such as the production stab mechanism 230. After installation, and after crossover assembly 10 is positioned in the tree with crossover bore 48 aligned with tree bore 46, annulus stab 35 and production stab 50 are extended to the position shown in FIG. 1.

Figure 8:
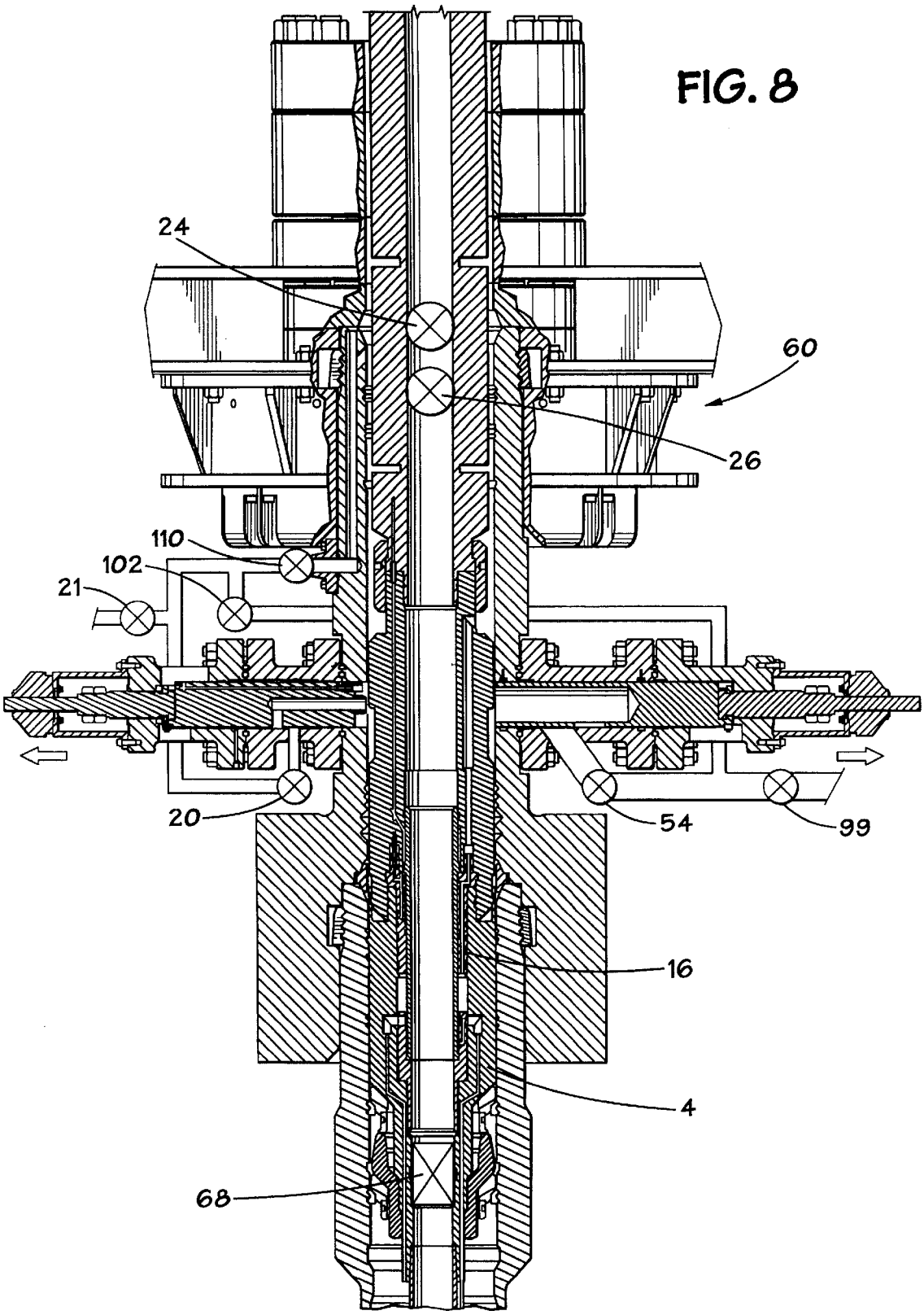
FIG. 8 depicts the installation/retrieval of the tubing hanger through the tree.

Referring next to FIG. 8, the tree assembly is shown without crossover assembly 10. In this configuration, which may be before installation of crossover assembly 10, or after retrieval of the same, full bore access to the wellbore through tree 2 is available. Full bore access advantageously enables workover of the well or other repairs and maintenance. Tubing hanger sliding valve 16 is in the open position in this Figure. Wireline plug 68 is also in place within tubing hanger 4 in this configuration. In order to accomplish the installation and/or retrieval of the crossover assembly, however, the production stab 50 and annulus stab 35 must first be retracted as shown.

Figure 31:
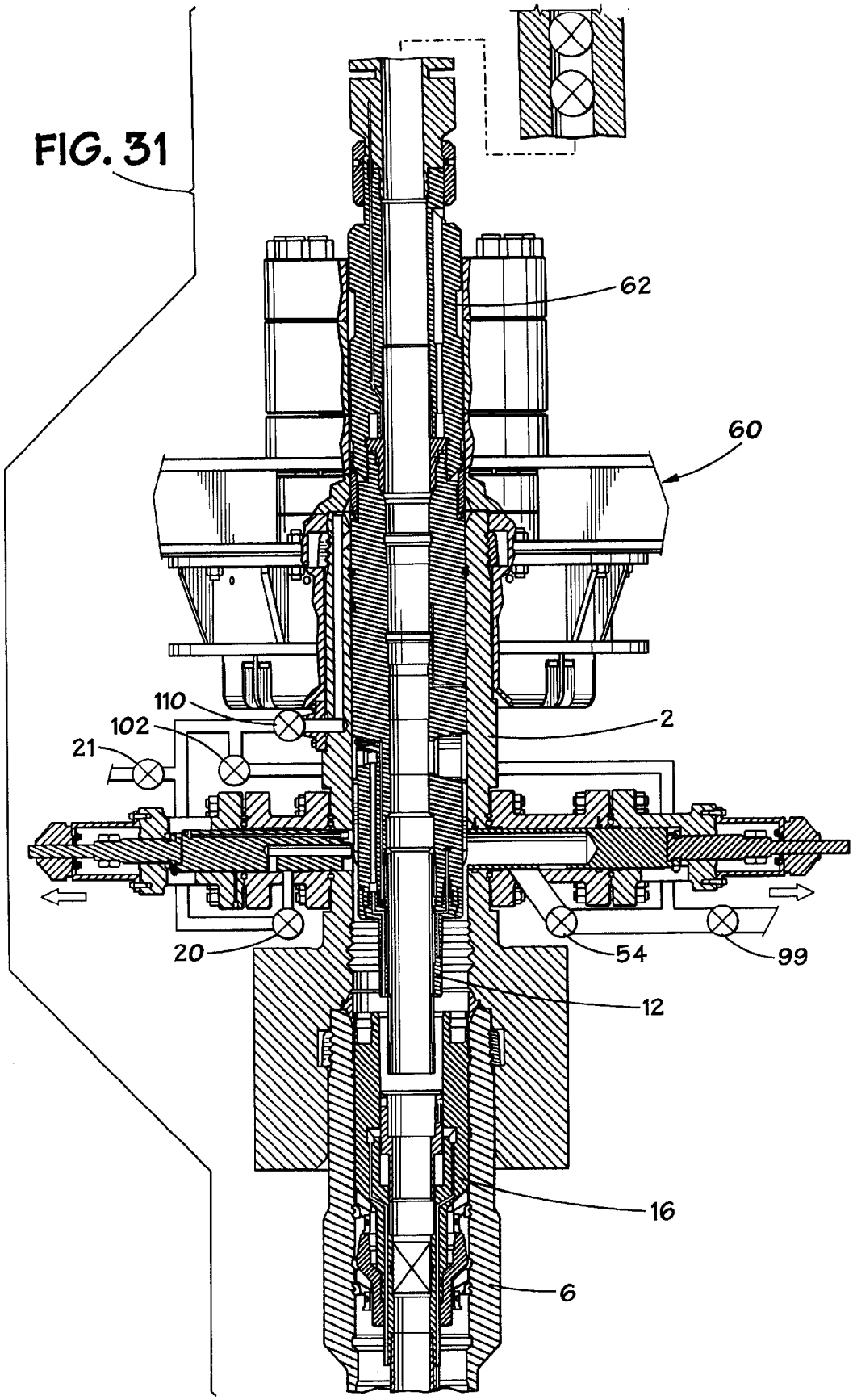
FIG. 31 depicts a cross sectional view of the CTS with a safety tree.

Referring next to FIG. 31, the crossover assembly 10 is being installed through BOP 60.

Figure 32:
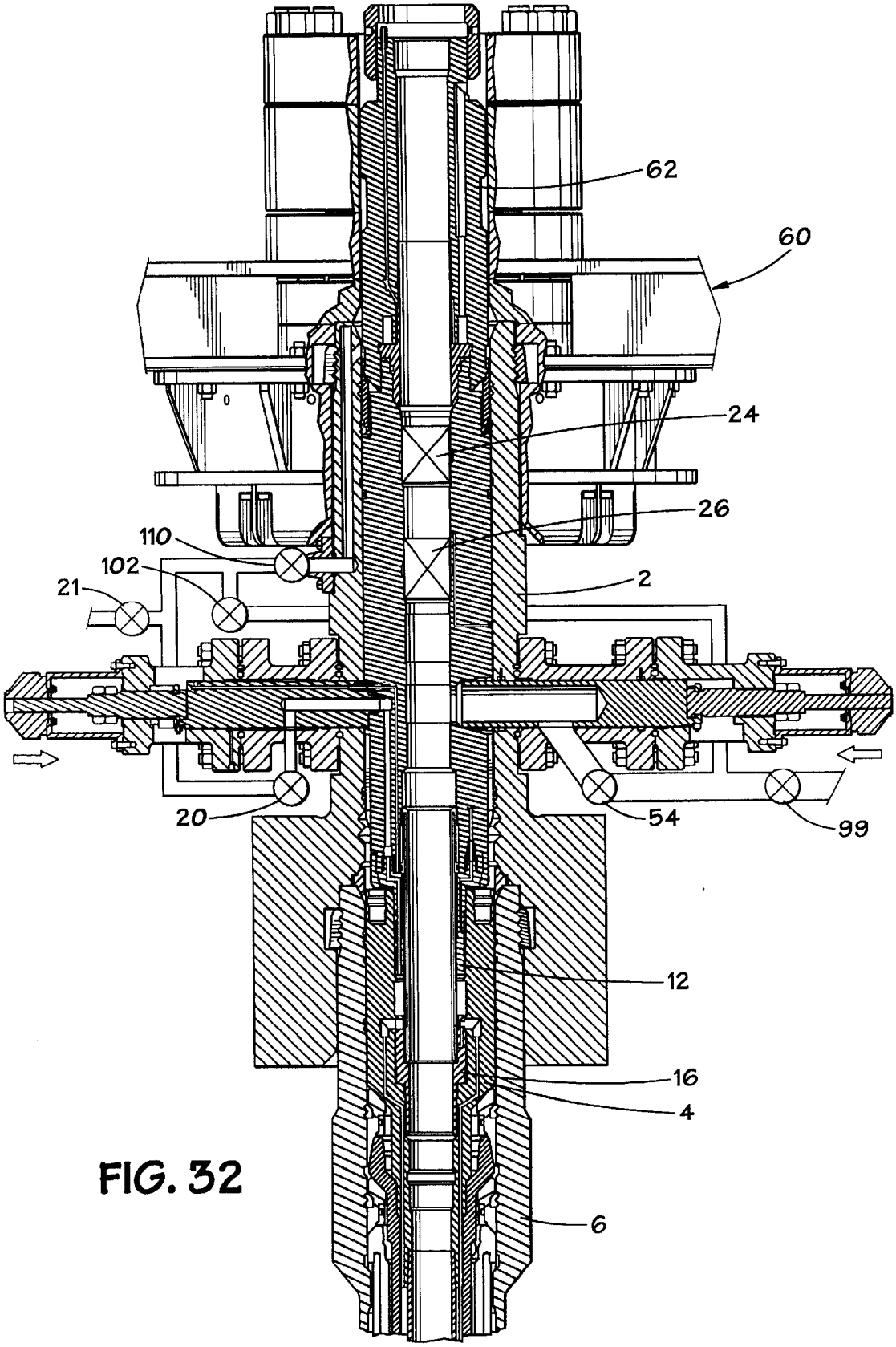
FIG. 32 depicts a cross sectional view of the CTS in the crossover assembly installation sequence.

Referring next to FIG. 32, crossover assembly 10 has been installed by multi purpose running tool 62 and crossover stab 12 extended to force sliding valve 16 into the open position. Tubing hanger plug 68 is retrieved. Wireline plugs 24 and 26 may then be set in anticipation of production. Alternatively, in a retrieval operation, wireline plugs may be retrieved and crossover assembly 10 and crossover stab 12 may be retrieved as well.

Figure 33:
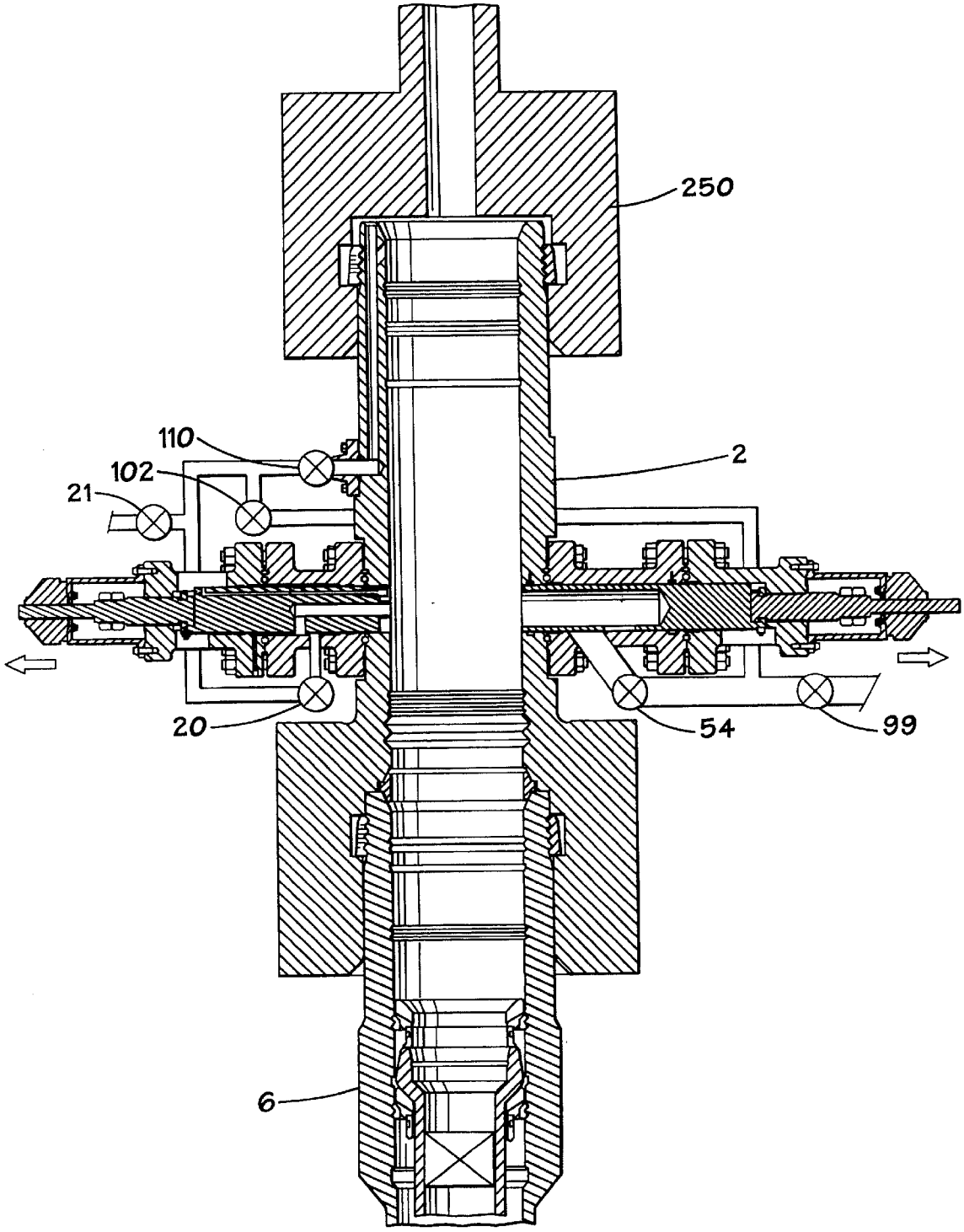
FIG. 33 depicts a cross sectional view of the installation/retrieval of the tree.

Referring next to FIG. 33, an installation/retrieval sequence for christmas tree 2 is shown. Christmas tree 2 is shown running on a tree running tool 250. Tree running tool 250 may be used similarly to retrieve tree 2.

Figure 35:
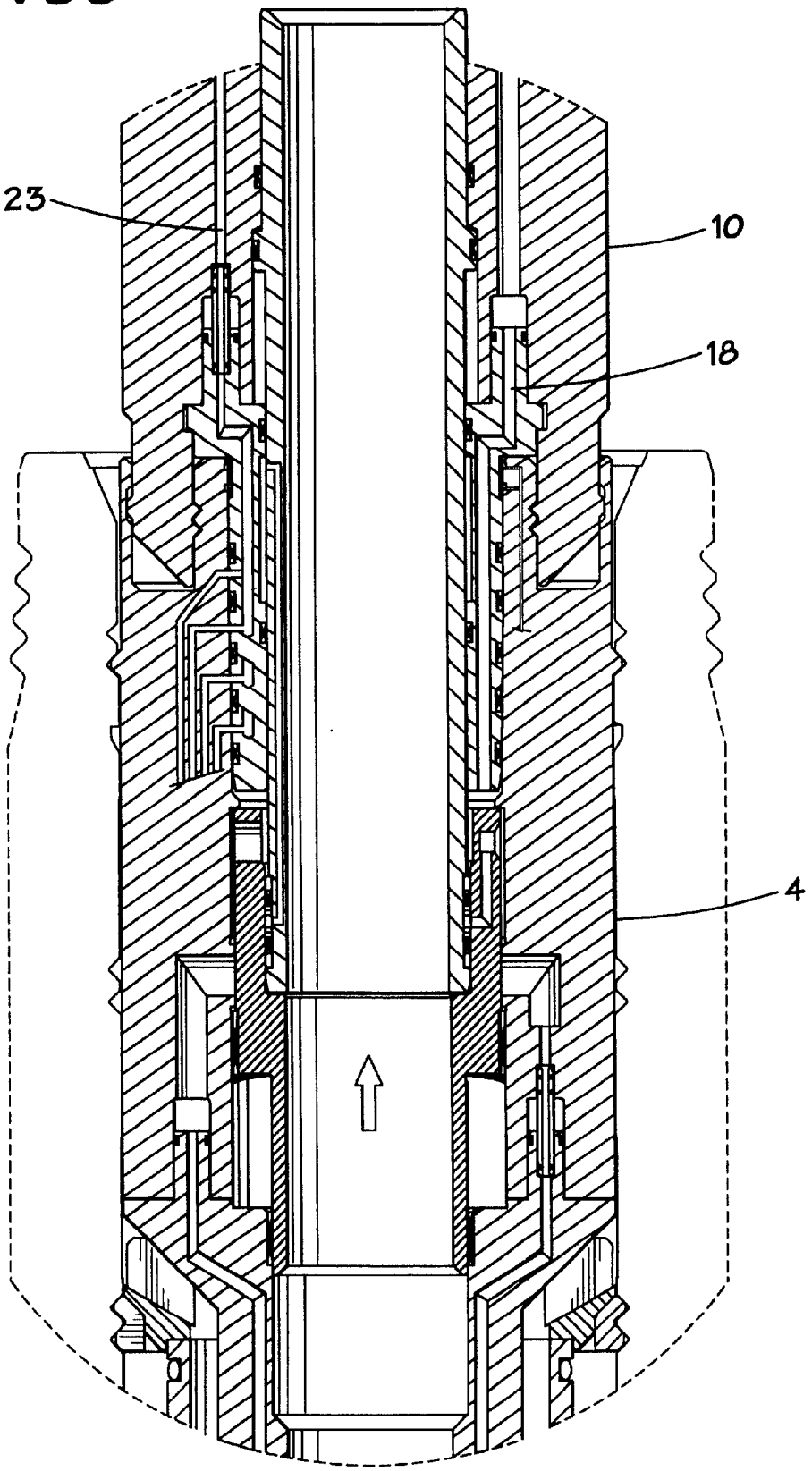

Referring next to FIGS. 34 and 35, a detail of the interface between crossover assembly 10 and tubing hanger 4 is shown. The flow path of annulus access channels 18 are more clearly seen as it extends through the crossover assembly and to the tubing hanger via an annulus cavity 252. Likewise, the flow path of the chemical injection channels 23 are more clearly seen as they extend through the crossover assembly and to the tubing hanger via a series of bores 254. Sliding valve 16 facilitates and/or prevents the flow of through all of the annulus access channels 18 and chemical injection channels 23.

Figure 38:
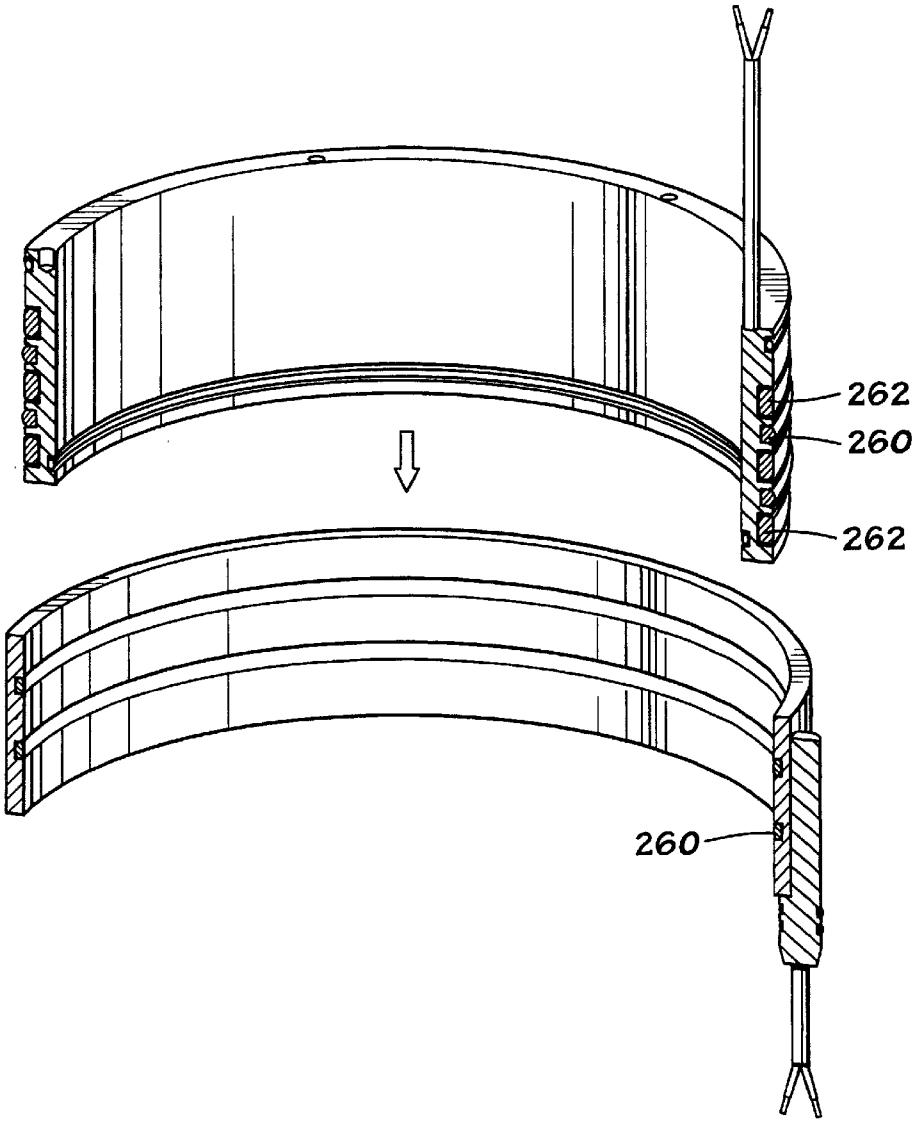
FIGS. 37–38 depict details of the electrical interface between the crossover assembly and the tubing hanger.
Figure 37:
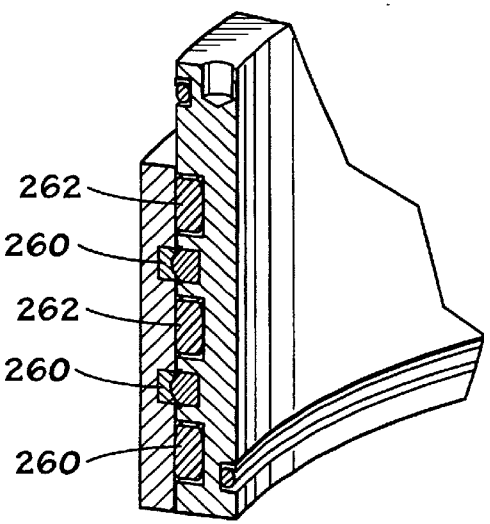

In some embodiments of the present invention the engagement between crossover assembly 10 and tubing hanger 4 includes one or more electrical contacts 260. As shown in FIGS. 37–38, the electrical contacts may be separated isolated by a number of seals 262.

Figure 9C:
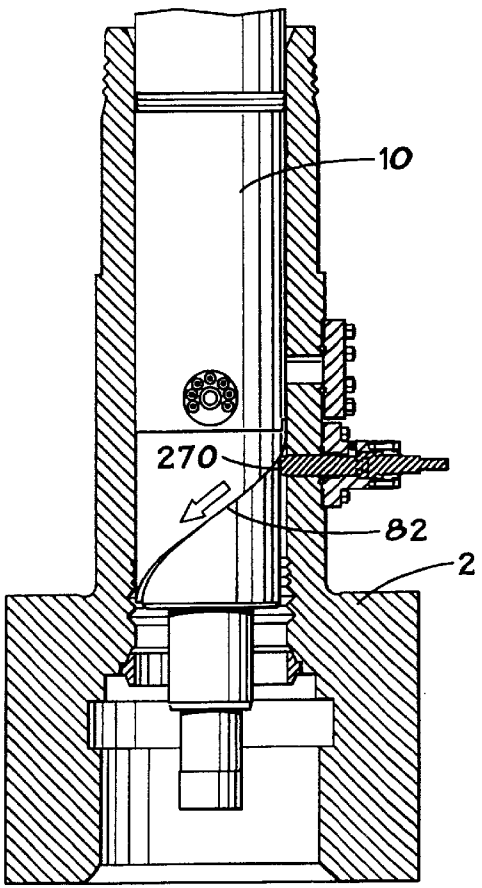
FIGS. 9*a*–9*c* depict a view of the alignment mechanism on the crossover assembly.
Figure 9B:
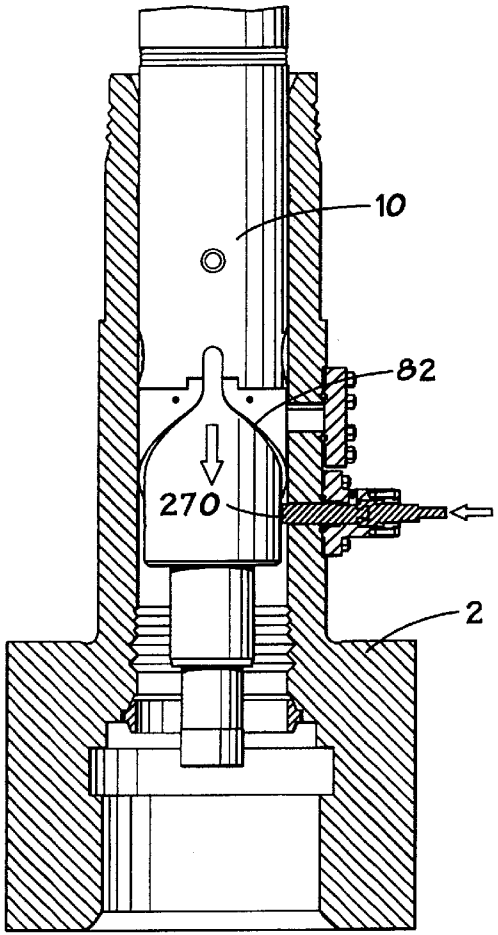
Figure 9A:
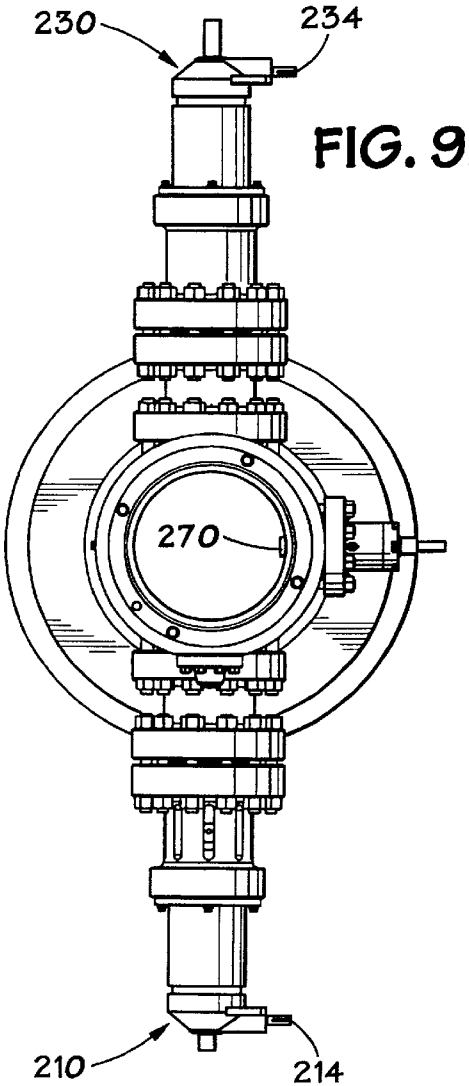

Referring next to FIGS. 9*a*–9*c*, it can be seen that an integral orientation helix 82 may be included on crossover assembly 10. Orientation helix 82 shaped such that upon installation of crossover assembly 10, the assembly is directed into the correct orientation position with crossover bore 48 aligned with tree bore 46. Orientation helixes and their use are well known in the art. Alignment pin 270 extending through tree 2 engages helix 82 and directs the crossover assembly to the desired orientation.

The present invention thus advantageously facilitates a horizontal tree and tubing hanger to each be independently retrievable with full-bore wellhead access.

Referring next to FIG. 10, a hydraulic schematic for the crossover tree system (designated CTS in FIGS. 10 through 21) in accordance with one embodiment of the invention in the production mode is disclosed. The production system valving may include a production master valve 54 and optionally a production wing valve 99 to facilitate control of the production fluids from the wellbore. Access to the tubing annulus may also be facilitated by the valving scheme shown in FIG. 10. An annulus master valve 20 facilitates primary access to the annulus. An annulus wing valve 21 may allow the flow of annular fluids to an external connection or may be the means by which annular fluids are introduced through an external connection. In series with the annular master valve may be an annulus circulation valve 100 to regulate flow and/or pressure in the annulus and provide a communication with the longitudinal throughbore of tree 2. In addition, a crossover valve 102 may allow the operator to open or close fluid communication between the production line and the annulus.

Referring next to FIG. 12, one of a second set of sequences in accordance with the invention is shown. FIG. 12 depicts the installation and/or retrieval of tubing hanger 4 within wellhead 6. Generally, tubing hanger 4 is installed while a blowout preventor (BOP) stack 60 is attached to wellhead 6. BOP stack 60 is conventional and well known to one of skill in the art. With BOP stack 60 in place, tubing hanger 4 and running tool 62 are inserted into or retrieved from wellhead 6. Running tool stab 113 is in the working or down position as shown in FIG. 12. Tubing hanger 4 and running tool stab 113 are attached to multi purpose running tool 62. In some embodiments tubing hanger 4 includes tubing hanger lifting grooves 64, which engages with dogs 66 at the distal end of multi purpose running tool 62 during installation and/or retrieval of tubing hanger 4. When tubing hanger 4 is being installed, the hanger continues downhole via multi purpose running tool 62 until it engages wellhead shoulder 8. When tubing hanger 4 engages wellhead shoulder 8, tubing hanger lockdown dogs 56 lock the hanger in place and multi purpose running tool 62 may be returned to surface. In a preferred embodiment, tubing hanger 4 is a non-oriented tubing hanger, although oriented tubing hangers may be provided.

Figure 13:
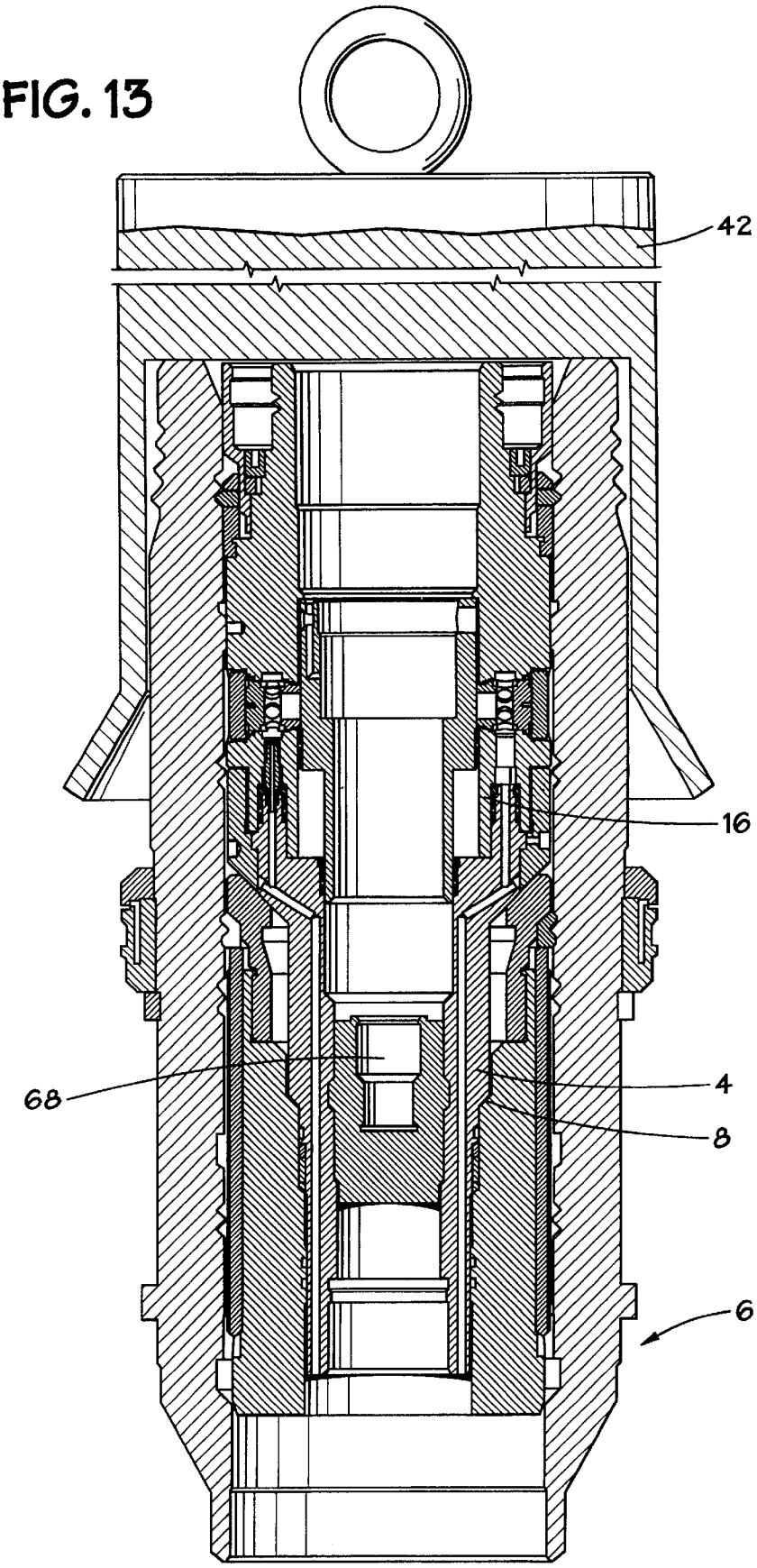
FIG. 13 depicts a cross sectional view of the CTS in the retrieve BOP stack/ROV install debris cap sequence.

Referring next to FIG. 13, with tubing hanger 4 positioned within wellhead 6, crossover stab 12 is removed and a wireline plug 68 or other closure is set inside the tubing hanger through BOP stack 60. The BOP stack may be retrieved and a temporary abandonment/debris cap assembly 42 may be installed and attached to wellhead 6 in the position shown in FIG. 13. Tubing hanger sliding valve 16 is in the up or sealed off position in this sequence to prevent flow through the annular access or chemical injection porting, as the assembly awaits the installation of tree 2.

Figure 14:
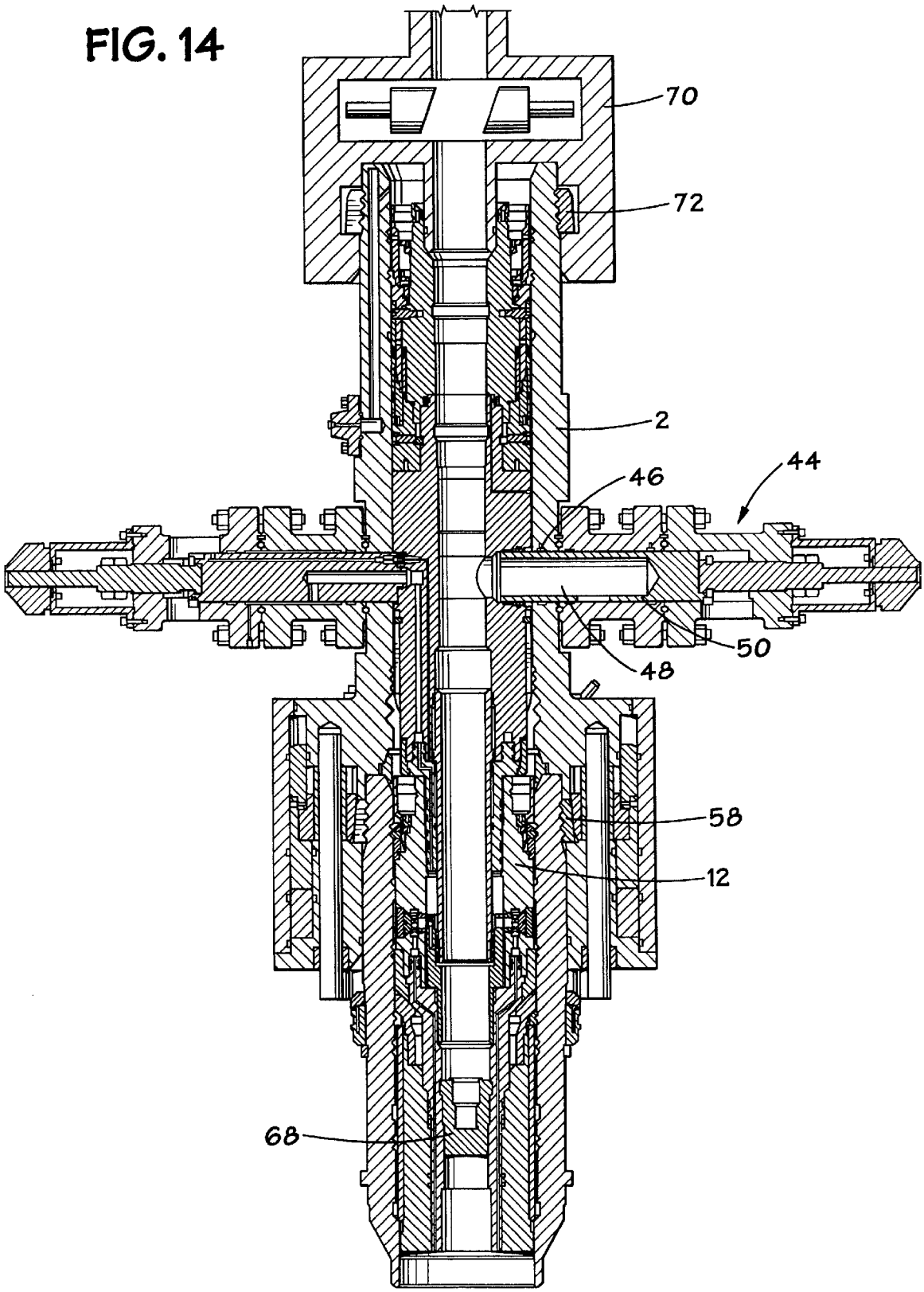
FIG. 14 depicts a cross sectional view of the CTS in the tree running sequence.

Referring next to FIG. 14, the temporary abandonment/debris cap assembly 42 is removed, and wireline plug 68 remains in place. Fully assembled tree 2 is then installed. Tree 2 is run on tree running tool 70 with crossover assembly 10, and crossover stab 12 inside tree body 2. Plugs 24 and 26 are not yet installed inside tree body 2 in this sequence. Crossover stab 12 is in the up or running position and tubing hanger sliding valve 16 is in the down/open position, which allows access to the tubing annulus (not shown) at the valve. Tree running tool 70 is attached to the exterior of tree body 2 via tree running tool lock down ring 72. The complete tree assembly 2 is run until tree lock down ring 58 engages with wellhead 6 and the tree is secured in the position shown in FIG. 14.

Referring next to FIGS. 15*a* and 15*b*, a detailed view of the tubing hanger 4 and crossover stab assembly 12 is shown. In FIG. 15*a*, crossover stab 12 is in the up or running position and tubing hanger sliding valve 16 is in the up or sealed position, which seals off the tubing annulus communication and chemical injection lines as tree 2 is installed.

For example, FIG. 15*a* shows that in the up or running position, first ports 17 (the annulus communication ports) in sliding valve 16 do not align with first ports 17*a* in tubing hanger 4. It will be understood to those of skill in the art that port 17*a* in the tubing hanger 4 may be one of several ports radially spaced around the tubing hanger, and extend down through the tubing hanger body to the tubing annulus. First ports 17*a* in tubing hanger 4, which may be arranged about the inner circumference of the tubing hanger, are preferably arranged equidistantly around the inner circumference of tubing hanger 4. By sizing the ports properly and selecting the appropriate number of ports first ports 17*a* provide a fluid communication path with sufficient flow area to the tubing annulus. The number of ports and/or the size of the ports may vary depending on the use and field characteristics.

Similarly, second ports 19*a* may provide a fluid communication path for chemical injection lines downhole for facilitating chemical insertions into the production and/or the formation. It will be appreciated that any number of porting arrangements and communications downhole may be provided.

The communications paths facilitated by first ports 17*a* and second ports 19*a* are, however, sealed off from respective first and second ports 17 and 19 in FIG. 15*a*. When tree 2 has been set, crossover stab .12 may be extended into tubing hanger 4 to the position shown in FIG. 15*b* until first ports 17 and second ports 19 in valve 16 align with first ports 17*a* and second ports 19*a* in tubing hanger 4, respectively. Alignment is accomplished when the shoulder 13 of shuttle valve 16 contacts ledge 90 of tubing hanger FIG. 6 depicts the next sequence in which the tubing hanger plug 68 is retrieved on wireline and crossover wireline plugs 24 and 26 are installed as shown. Tree running tool 70 (not shown) may then be retrieved and an ROV may install the temporary abandonment/debris cap 42.

An optional set of sequences are shown in FIGS. 17–21 and are described as follows. Referring to FIG. 1, tree 2 may be run with an empty body on tree running tool 70. In this sequence, the internal tree cap, crossover assembly 10, crossover stab 12, and plugs 24 and 26 are not in place inside tree body 2. Tree 2 is locked onto wellhead 6 as described previously.

Figure 18:
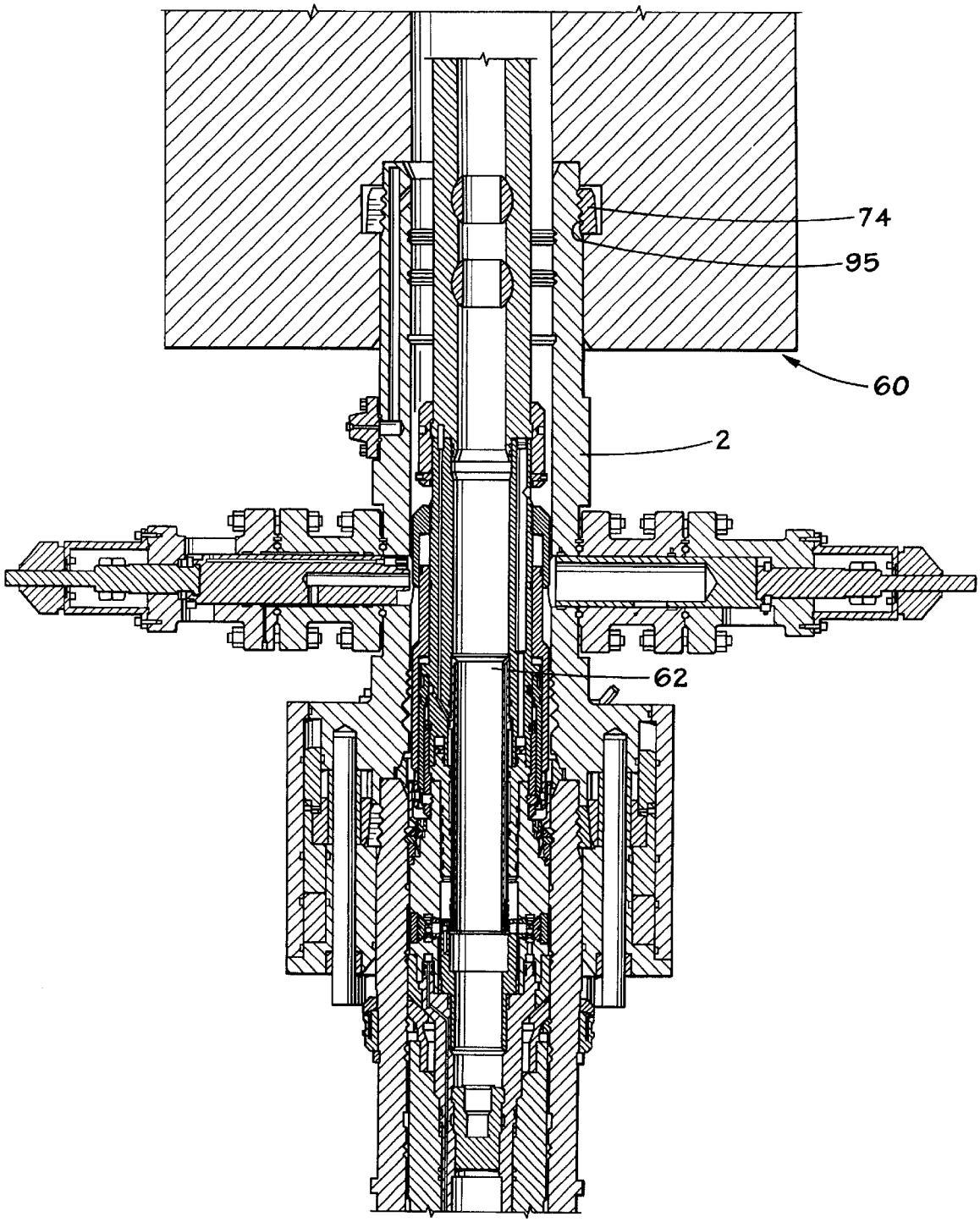
FIG. 18 depicts a cross sectional view of the CTS in the optional sequences of locking the BOP stack onto the spool body, running the tubing hanger with a multi-purpose running tool, and installing the tubing hanger wireline plug.

Referring next to FIG. 18, BOP stack 60 is run and locked onto tree 2 via BOP lockdown ring 74 which mates with matching profile 95 on tree 2. Tubing hanger 4 may be run in on multi use running tool 62 as described above. No orientation apparatus is required with the running of the tubing hanger. A wireline plug 68 may be installed in the tubing hanger 4.

Figure 19A:
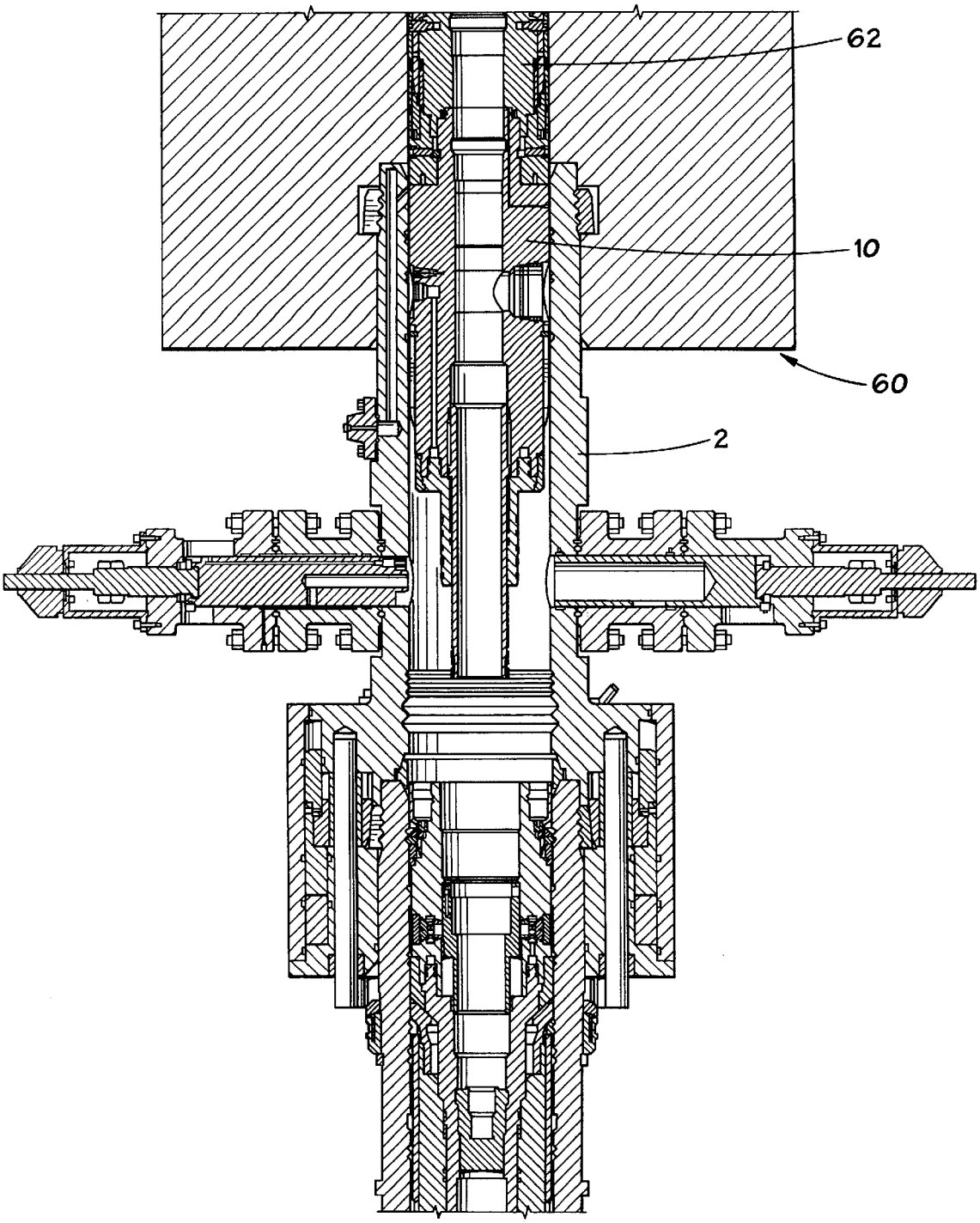
FIG. 19*a* depicts a cross sectional view of the CTS in the optional sequence of running the crossover assembly with the multi-purpose running tool in a first position.
Figure 19B:
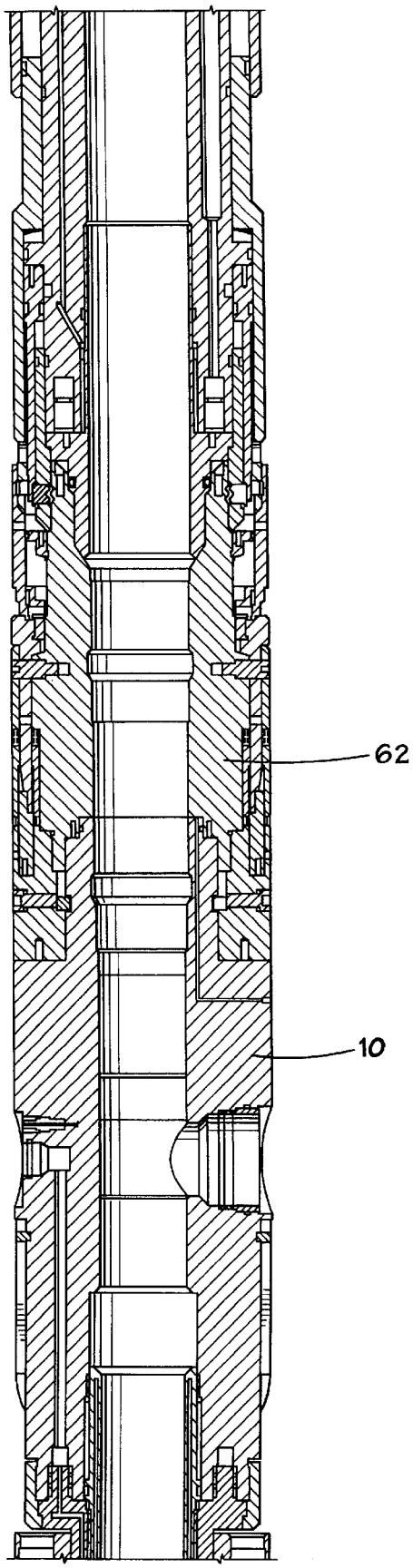
FIG. 19*b* depicts a detail of the connection between the crossover assembly and a multi-purpose running tool.
Figure 20A:
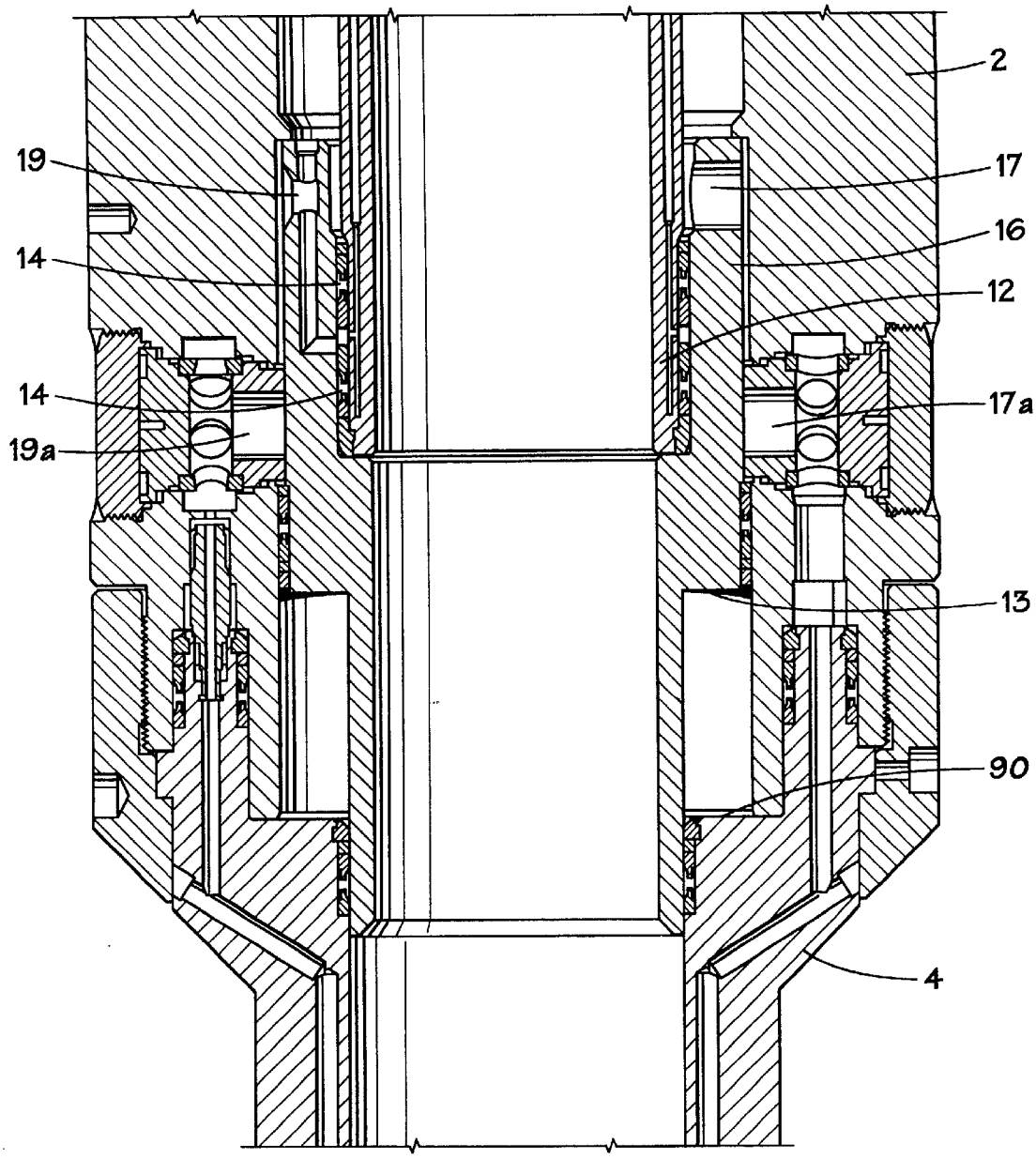
FIG. 20*a* depicts a cross sectional view of the CTS in the optional sequence of extending the crossover assembly stab into the tubing hanger in a first position.
Figure 20B:
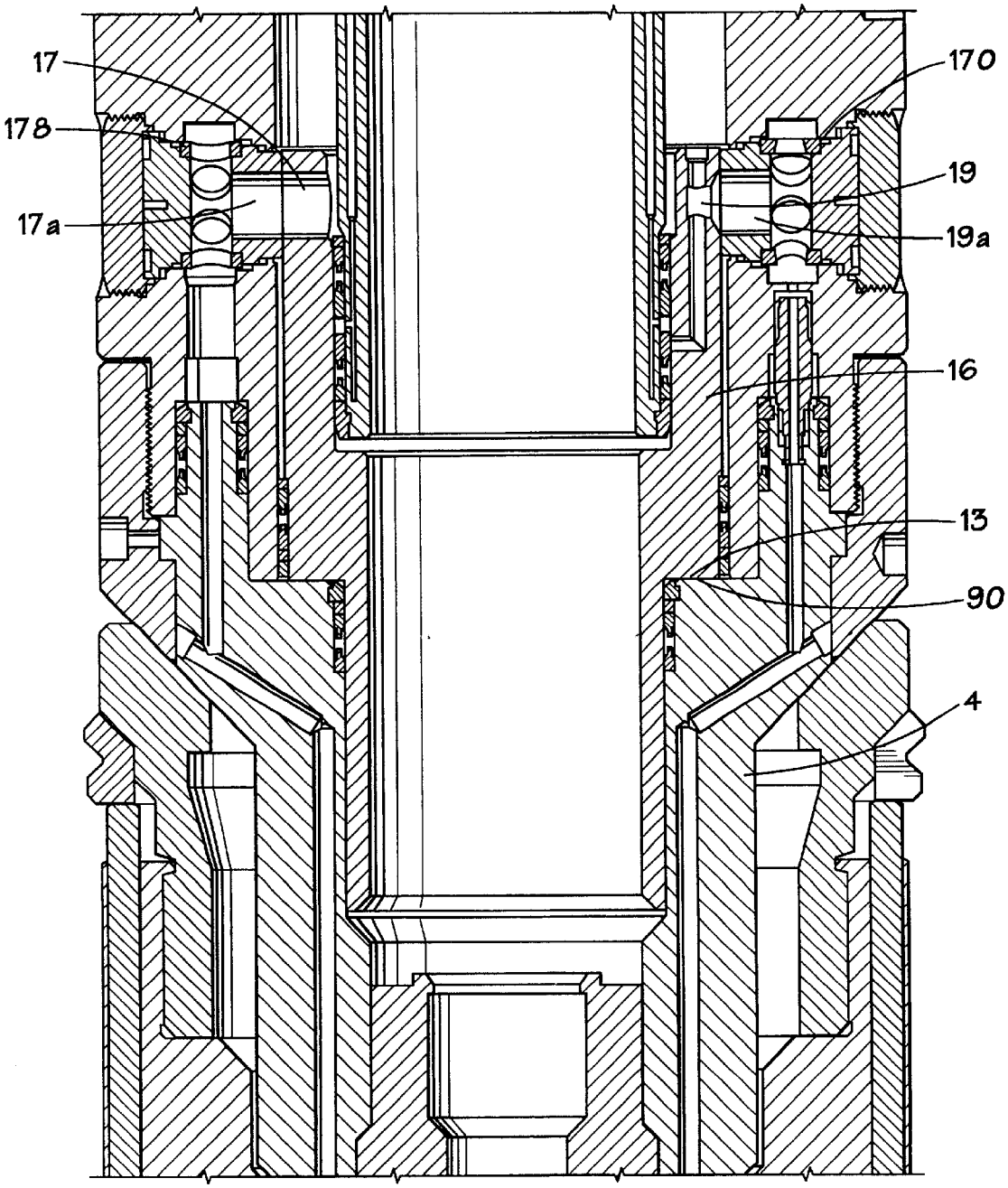
FIG. 20*b* depicts a cross sectional view of the CTS in the optional sequence of extending the crossover assembly stab into the tubing hanger in a second position.

Referring next to FIGS. 19*a* and 19*b*, crossover assembly 10 may be run on multi use running tool 62. Crossover assembly 10 self-orients within tree 2 with the aid of an orientation helix as described above and shown in FIG. 9. As shown in FIG. 19*b*, which is a detail of the multi use running tool 62, the running tool stab 113 (not shown in FIG. 19*b*) may be replaced by a bore protector FIGS. 20*a* and 20*b*, similar to FIGS. 15*a* and 15*b*, show the extension of crossover stab 12. In FIG. 20*a*, crossover stab 12 is in the up or running position and tubing hanger sliding valve 16 is in the up or sealed position, which seals off the tubing annulus (not shown) at the valve as tree 2 is installed. FIG. 20*a* shows that in the up or running position, upper ports 17 and lower ports 19 in sliding valve 16 do not align with upper ports 17*a* and lower ports 19*a* in tubing hanger 4. Upper ports 17*a* in tubing hanger 4, which may be arranged about the inner circumference of the tubing hanger, are preferably arranged equidistantly around the inner circumference of tubing hanger 4. Upper ports 17*a* provide a fluid communication path to the tubing annulus (not shown). Lower ports 19*a* provide a fluid communication path to the downhole tubing (not shown) for facilitating chemical insertions into the production formation. The communications paths facilitated by upper ports 17*a* and lower ports 19*a* are, however, sealed off from respective upper and lower ports 17 and 19 as shown in FIG. 20*a*. When tree 2 has been set, crossover stab 12 may be extended to the position shown in FIG. 20*b* until upper ports 17 and lower ports 19 in valve 16 align with upper ports 17*a* and lower ports 19*a* in tubing hanger 4, respectively. Alignment is accomplished when the shoulder 13 of shuttle valve 16 contacts ledge 90 of tubing hanger 4.

Referring next to FIG. 21, the CTS is shown completely installed. The optional sequence leading up to FIG. 21 as shown includes retrieving tubing hanger plug 68 (not shown in FIG. 21), installing crossover plugs 24 and 26 on wireline, retrieving BOP stack 60 (not shown in FIG. 21) and installing temporary abandonment/debris cap 42.

In view of the above disclosure, one of ordinary skill in the art should understand and appreciate that one illustrative embodiment of the present invention includes a subseaoil or gas well assembly that includes: a wellhead; a christmas tree coupled to the wellhead; and a tubing hanger landed within the wellhead. A sliding valve is disposed within the tubing hanger to selectively allow fluid communication between a first port in the sliding valve and a first port in the tubing hanger. A crossover assembly is landed within the tree body, and; a crossover stab is disposed within the crossover assembly and adapted to translate the sliding valve between open and closed positions. In a preferred version of the present illustrative embodiment, the tubing hanger is substantially concentric with the wellhead. Preferably the tubing hanger is a production tubing hanger with a production tubing suspended therefrom. The tubing hanger can also include an annulus access channel extending between the first port in the tubing hanger and an annulus, the annulus being defined between the production tubing and an innermost casing. The christmas tree preferably includes a radial annulus bore and a radial production bore. Alternatively the christmas tree includes an integral production bore valve. In one embodiment the illustrative assembly includes a plurality of annulus access channels arranged about the tubing hanger and extending between the annulus and a plurality of first ports. Preferably the plurality of annulus access channels converge to a common plenum. More preferably the annulus access channels reduce in number between the plenum and the christmas tree radial annulus bore. In one particularly preferred embodiment, the plurality of, annulus access channels provides an equivalent flow area of at least 1.5 inches. The assembly of the present illustrative embodiment can be designed such that the crossover stab further defines the annulus access channel. The crossover stab preferably defines the plurality of annulus access channels.

The above described illustrative embodiment can also include a a biasing member that is disposed between the tubing hanger and the sliding valve. The biasing member biases the sliding valve to the closed position. The crossover assembly further defines the annulus access channel and preferably the crossover assembly further defines more than one annulus access channel. In one illustrative embodiment, the sliding valve facilitates fluid communication between the annulus access channel defined by the crossover assembly and the annulus access channel defined by the crossover stab. The illustrative embodiment of the present invention can alternatively include a christmas tree that further defines the annulus access channel. Preferably the crossover assembly further includes a radial annulus bore and a radial production bore. More preferably, the crossover assembly further includes an orientation helix for facilitating the alignment of the crossover radial annulus bore with the tree radial annulus bore and the crossover radial production bore with the tree radial production bore.

It is also contemplated that the assembly of the present invention includes an extendable/retractable production stab, the production stab being extendable between the tree radial production bore and the crossover radial production bore. In one illustrative embodiment including the extendable/retractable annulus stab, the annulus stab is extendable between the tree radial annulus bore and the crossover radial annulus bore. The tree and the crossover assembly are preferably independently retrievable when the annulus stab is retracted. In a similar manner it is contemplated that the tree and the crossover assembly are independently retrievable when the production stab is retracted. The production stab mechanism includes a first shaft, a second shaft operatively connected to the first shaft by a pair of bevel gears, and a threaded connection between production stab and the first shaft. Preferably the mechanism further includes an anti-rotation key to prevent the production stab from rotating with the first shaft. The assembly of the present invention may also include an annulus stab mechanism in which the mechanism includes a first shaft, a second shaft operatively connected to the first shaft by a pair of bevel gears, and a threaded connection between annulus stab and the first shaft. In one preferred embodiment, the mechanism further includes an anti-rotation key to prevent the annulus stab from rotating with the first shaft. The assembly of the present illustrative embodiment alternatively includes a second port in the sliding valve to selectively allow fluid communication of chemicals between the second port in the sliding valve and a second port in the tubing hanger. In such an illustrative assembly, the tubing hanger includes a chemical injection channel extending between the second port in the tubing hanger and a production tubing. A plurality of chemical injection channels is contemplated and may be arranged about the tubing hanger and extending between the production tubing and a plurality of second ports. In one illustrative embodiment, the plurality of chemical injection channels converge to a common plenum. Preferably the plurality of chemical injection channels reduce in number between the plenum and a christmas tree chemical channel and more preferably the plurality of chemical injection channels provides an equivalent flow area of at least 0.375 square inches. The crossover stab, in one illustrative embodiment, further defines the chemical injection channel and it is preferred that it defines a plurality of chemical injection channels. Alternatively the crossover assembly can define the chemical injection channel and preferably the crossover assembly defines the one or more chemical injection channels. In one illustrative embodiment, the sliding valve facilitates fluid communication between the chemical injection channel defined by the crossover assembly and the chemical injection channel defined by the crossover stab. Alternatively, the christmas tree can further define the chemical injection channel.

As is presently contemplated, the present invention may also encompass a subsea oil or gas well assembly that includes: a wellhead; a christmas tree coupled to the wellhead; and a single bore tubing hanger landed within the wellhead. The tubing hanger has a production tubing suspended from it The single bore tubing hanger further includes a plurality of first closable ports therein, the first closable ports facilitating fluid communication to an annulus defined by the production tubing and an innermost casing. The single bore tubing hanger further includes a plurality of tubing hanger annulus access channels extending from at least one of the plurality of first closable ports to the annulus. The illustrative assembly optionally includes a plurality of uphole annulus access channels in which the plurality of first closable ports are correspondingly alignable with the uphole annulus access channels to facilitate fluid communication between the uphole annulus access channels and the tubing hanger annulus access channels. The illustrative assembly can alternatively include a crossover assembly landed within the tree, wherein the uphole annulus access channels extend through aligned radial bores in the crossover assembly and the christmas tree. In one such embodiment the uphole annulus access channels extend longitudinally through the christmas tree. The assembly can be embodied such that the crossover assembly further includes a crossover stab and the plurality of first closable ports further comprises a sliding valve. The sliding valve is operable to open and close the first closable ports to selectively allow fluid communication between the tubing hanger annulus access channels and the uphole annulus access channels. Alternatively, the plurality of uphole annulus access channels can converge to a common plenum, such that the number of uphole annulus access channels is reduced between the plenum and the christmas tree. The present illustrative assembly can be made such that the single bore tubing hanger further includes a second plurality of closable ports and a plurality of tubing hanger chemical injection channels extending from the second plurality of closable ports, through the tubing hanger, and to the tubing hanger bore. The assembly may alternatively be made to include a plurality of uphole chemical injection channels, in which the plurality of first closable ports are correspondingly alignable with the uphole chemical injection channels to facilitate fluid communication between the uphole chemical injection channels and the tubing hanger chemical injection channels. The crossover assembly can be landed within the tree, such that the uphole chemical injection channels extend through aligned longitudinal bores arranged about the crossover assembly and the christmas tree. The crossover assembly can also include a crossover stab and the plurality of second closable ports further comprises a sliding valve. In such an illustrative embodiment, the sliding valve is operable to open and close the second closable ports to selectively allow fluid communication between the tubing hanger chemical injection channels and the uphole chemical injection channels. In another illustrative embodiment of the present invention, the plurality of uphole chemical injection channels converge to a common plenum, and wherein the number of uphole chemical injection channels is reduced between the plenum and the christmas tree.

The present invention also contemplates a method of servicing a subseawell. Such an illustrative method includes the steps of: providing a wellhead preferably with a BOP stack mounted onto the wellhead; installing a tubing hanger the wellhead and installing a christmas tree with an internal crossover assembly mounted therein onto the wellhead In one embodiment, the tubing hanger includes: a bore concentric with the wellhead and a plurality of channels bored longitudinally partially therethrough, the plurality of channels being spaced around the circumference of the tubing hanger. In another embodiment, the tubing hanger further includes a plurality of first ports and a plurality of second ports and a sliding valve for selectively opening and closing the first and second pluralities of ports. In another embodiment, the christmas tree includes an extendable/retractable stab between radial bores in the crossover assembly and christmas tree. The illustrative method may also include the step of retracting the stab. Optionally, the method may include the step of retrieving the christmas tree separately from the tubing hanger. In another illustrative embodiment the method includes the step of retrieving the crossover assembly and the tubing hanger while the christmas tree remains connected to the wellhead. In yet another illustratvie embodiment, the method may include the step of opening the sliding valve by inserting a crossover stab to position the sliding valve in an open position.

One of ordinary skill in the art should also appreciate that the present invention includes a subsea wellbore production apparatus with a side-production bore christmas tree, a production tubing hanger, and an internal crossover assembly. It should be appreciated that the improvement to such an apparatus includes a production stab that is retractable into the christmas tree and extendable between radial bores in the christmas tree and the crossover assembly. In such an apparatus, the stab provides a sealed flow path between the crossover assembly and the christmas tree. Preferably the production stab further includes an actuation mechanism. The actuation mechanism includes: a first rotatable shaft in threaded engagement with the production stab; and a rotational key lock preventing rotation of the production stab; such that rotation of the first shaft is translated into axial movement of the production stab. The apparatus may also include a second rotatable shaft operatively connected to the first rotational shaft by gears, wherein rotation of the second rotatable shaft is translated into rotation of the first rotational shaft. The illustrative apparatus may optionally include an annulus stab which is retractable into the christmas tree and extendable between second radial bores in the christmas tree and the crossover assembly. The apparatus preferably has a plurality of annulus access channels spaced around the tubing hanger and the crossover assembly, and wherein the annulus access channels communicate with a christmas tree annulus channel. In an alternative embodiment, the apparatus includes a plurality of chemical injection channels spaced around the tubing hanger and the crossover assembly, and wherein the chemical injection channels communicate with a christmas tree chemical injection channel.

While the present invention has been particularly shown and described with reference to a particular illustrative and preferred embodiments thereof, it will be understood by those skilled in the art that various changes in form and details may be made without departing from the scope of the invention. The above-described embodiments are intended to be merely illustrative, and should not be considered as limiting the scope of the present invention which is defined in the claims.

What is claimed is:

1. A subsea oil or gas well assembly comprising:

a) a wellhead;

b) a christmas tree coupled to the wellhead;

c) a tubing hanger landed within the wellhead;

d) a sliding valve disposed within the tubing hanger to selectively allow fluid communication between a first port in the sliding valve and a first port in the tubing hanger;

e) a crossover assembly landed within the tree body, and;

f) a crossover stab disposed within the crossover assembly and adapted to translate the sliding valve between open and closed positions.

2. The assembly of claim 1 wherein the tubing hanger is substantially concentric with the wellhead.

3. The assembly of claim 1 wherein the tubing hanger is a production tubing hanger with a production tubing suspended therefrom.

4. The assembly of claim 1 wherein the christmas tree further comprises a radial annulus bore and a radial production bore.

5. The assembly of claim 4 wherein the christmas tree further comprises an integral production bore valve.

6. The assembly of claim 4 wherein the tubing hanger further comprises an annulus access channel extending between the first port in the tubing hanger and an annulus, the annulus being defined between the production tubing and an innermost casing.

7. The assembly of claim 6 further comprising a plurality of annulus access channels arranged about the tubing hanger and extending between the annulus and a plurality of first ports.

8. The assembly of claim 7 wherein the plurality of annulus access channels converge to a common plenum.

9. The assembly of claim 8 wherein the plurality of annulus access channels reduce in number between the plenum and the christmas tree radial annulus bore.

10. The assembly of claim 7 wherein the plurality of annulus access channels provides an equivalent flow area of at least 1.5 inches.

11. The assembly of claim 6 wherein the crossover stab further defines the annulus access channel.

12. The assembly of claim 7 wherein the crossover stab further defines the plurality of annulus access channels.

13. The assembly of claim 1 further comprising a biasing member disposed between the tubing hanger and the sliding valve.

14. The assembly of claim 13 wherein the biasing member biases the sliding valve to the closed position.

15. The assembly of claim 11 wherein the crossover assembly further defines the annulus access channel.

16. The assembly of claim 12 wherein the crossover assembly further defines the more than one annulus access channel.

17. The assembly of claim 15 wherein the sliding valve facilitates fluid communication between the annulus access channel defined by the crossover assembly and the annulus access channel defined by the crossover stab.

18. The assembly of claim 15 wherein the christmas tree further defines the annulus access channel.

19. The assembly of claim 4 wherein the crossover assembly further comprises a radial annulus bore and a radial production bore.

20. The assembly of claim 19 wherein the crossover assembly further comprises an orientation helix facilitating the alignment of the crossover radial annulus bore with the tree radial annulus bore and the crossover radial production bore with the tree radial production bore.

21. The assembly of claim 20 further comprising an extendable/retractable production stab, the production stab being extendable between the tree radial production bore and the crossover radial production bore.

22. The assembly of claim 21 further comprising an a production stab mechanism; the mechanism comprising a first shaft, a second shaft operatively connected to the first shaft by a pair of bevel gears, and a threaded connection between production stab and the first shaft.

23. The assembly of claim 22 wherein the mechanism further comprises an anti-rotation key to prevent the production stab from rotating with the first shaft.

24. The assembly of claim 20 further comprising an extendable/retractable annulus stab, the annulus stab being extendable between the tree radial annulus bore and the crossover radial annulus bore.

25. The assembly of claim 21 further comprising an annulus stab mechanism; the mechanism comprising a first shaft, a second shaft operatively connected to the first shaft by a pair of bevel gears, and a threaded connection between annulus stab and the first shaft.

26. The assembly of claim 22 wherein the mechanism further comprises an anti-rotation key to prevent the annulus stab from rotating with the first shaft.

27. The assembly of claim 4 further comprising a second port in the sliding valve to selectively allow fluid communication of chemicals between the second port in the sliding valve a second port in the tubing hanger.

28. The assembly of claim 27 wherein the tubing hanger further comprises a chemical injection channel extending between the second port in the tubing hanger and a production tubing.

29. The assembly of claim 28 further comprising a plurality of chemical injection channels arranged about the tubing hanger and extending between the production tubing and a plurality of second ports.

30. The assembly of claim 29 wherein the plurality of chemical injection channels converge to a common plenum.

31. The assembly of claim 30 wherein the plurality of chemical injection channels reduce in number between the plenum and a christmas tree chemical channel.

32. The assembly of claim 29 wherein the plurality of chemical injection channels provides an equivalent flow area of at least 0.375 inches.

33.The assembly of claim 28 wherein the crossover stab further defines the chemical injection channel.

34. The assembly of claim 29 wherein the crossover stab further defines the plurality of chemical injection channels.

35.The assembly of claim 33 wherein the crossover assembly further defines the chemical injection channel.

36. The assembly of claim 34 wherein the crossover assembly further defines the one or more chemical injection channels.

37. The assembly of claim 35 wherein the sliding valve facilitates fluid communication between the chemical injection channel defined by the crossover assembly and the chemical injection channel defined by the crossover stab.

38. The assembly of claim wherein the christmas tree further defines the chemical injection channel.

39. A subsea oil or gas well assembly comprising:

a) A wellhead;

b) a christmas tree coupled to the wellhead;

c) a single bore tubing hanger landed within the wellhead, the tubing hanger having a production tubing suspended therefrom;

wherein the single bore tubing hanger further comprises a plurality of first closable ports therein, and a plurality of tubing hanger annulus access channels extending from at least one of the plurality of first closable ports to an annulus defined by the production tubing and an innermost casing, the first closable ports facilitating fluid communication to the annulus defined by the production tubing and an innermost casing.

40. The assembly of claim 39 further comprising a plurality of uphole annulus access channels, wherein the plurality of first closable ports are correspondingly alignable with the uphole annulus access channels to facilitate fluid communication between the uphole annulus access channels and the tubing annulus access channels.

41. The assembly of claim 40 further comprising a crossover assembly landed within the tree, wherein the uphole annulus access channels extend through aligned radial bores in the crossover assembly and the christmas tree.

42. The assembly of claim 41 wherein the crossover assembly further comprises a crossover stab and the plurality of first closabe ports further comprises a sliding valve.

43. The assembly of claim 42 wherein the sliding valve is operable to open and close the first closable ports to selectively allow fluid communication between the tubing hanger annulus access channels and the uphole annulus access channels.

44. The assembly of claim 41 wherein the plurality of uphole annulus access channels converge to a common plenum, and wherein the number of uphole annulus access channels is reduced between the plenum and the christmas tree.

45. The assembly of claim 39 wherein the single bore tubing hanger further comprises a second plurality of closable ports and a plurality of tubing hanger chemical injection channels extending from the second plurality of closable ports, through the tubing hanger, and to the tubing hanger bore.

46. The assembly of claim 45 further comprising a plurality of uphole chemical injection channels, wherein the plurality of first closable ports are correspondingly alignable with the uphole chemical injection channels to facilitate fluid communication between the uphole chemical injection channels and the tubing hanger chemical injection channels.

47. The assembly of claim 46 further comprising a crossover assembly landed within the tree, wherein the uphole chemical injection channels extend through aligned longitudinal bores arranged about the crossover assembly and the christmas tree.

48. The assembly of claim 47 wherein the crossover assembly further comprises a crossover stab and the plurality of second closable ports further comprises a sliding valve.

49. The assembly of claim 48 wherein the sliding valve is operable to open and close the second closable ports to selectively allow fluid communication between the tubing hanger chemical injection channels and the uphole chemical injection channels.

50. The assembly of claim 45 wherein the plurality of uphole chemical injection channels converge to a common plenum, and wherein the number of uphole chemical injection channels is reduced between the plenum and the christmas tree.

51. A method of servicing a subsea well comprising the steps of:

a) providing a wellhead b) installing a tubing hanger into the wellhead, the tubing hanger comprising:

a bore concentric with the wellhead and a plurality of channels bored longitudinally partially therethrough, the plurality of channels being spaced around the circumference of the tubing hanger;

c) installing a christmas tree with an internal crossover assembly mounted therein onto the wellhead;

wherein the christmas tree includes an extendable/retractable stab between radial production and annulus bores in the crossover assembly and christmas tree.

52. The method of claim 51 further comprising the step of retracting the stab.

53. The method of claim 52 further comprising the step of retrieving the christmas tree separately from the tubing hanger.

54. The method of claim 52 further comprising the step of retrieving the crossover assembly and the tubing hanger while the christmas tree remains connected to the wellhead.

55. The method of claim 51 wherein the tubing hanger further comprises a plurality of first ports and a plurality of second ports and a sliding valve for selectively opening and closing the first and second pluralities of ports.

56. The method of claim 55 further comprising the step of opening the sliding valve by inserting a crossover stab to position the sliding valve in an open position.

57. The assembly of claim 21 wherein both the tree and the crossover assembly are independently retrievable when the production stab is retracted.

58. The assembly of claim 24 wherein both the tree and the crossover assembly are independently retrievable when the annulus stab is retracted.

59. The assembly of claim 41 wherein the uphole annulus access channels extend longitudinally through the christmas tree.

* * * * *